US006653038B2

(12) United States Patent
Matsunaga et al.

(10) Patent No.: US 6,653,038 B2
(45) Date of Patent: Nov. 25, 2003

(54) TONER, IMAGE FORMING METHOD AND PROCESS CARTRIDGE

(75) Inventors: Satoshi Matsunaga, Mishima (JP); Junko Yoshikawa, Toride (JP); Ryota Kashiwabara, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/097,261

(22) Filed: Mar. 15, 2002

(65) Prior Publication Data

US 2003/0044708 A1 Mar. 6, 2003

(30) Foreign Application Priority Data

Mar. 15, 2001 (JP) ..... 2001-073481

(51) Int. Cl.[7] ..... G03G 9/087

(52) U.S. Cl. ..... 430/108.22; 430/108.5; 430/111.4; 430/124; 399/262

(58) Field of Search ..... 430/108.5, 108.22, 430/109.4, 108.8, 124, 109.3, 111.4; 399/262

(56) References Cited

U.S. PATENT DOCUMENTS 4,883,735 A 11/1989 Watanabe et al. ..... 430/109
5,721,433 A 2/1998 Kosaka ..... 250/573
5,728,501 A * 3/1998 Nakanishi et al. ..... 430/110

FOREIGN PATENT DOCUMENTS

| | | |
|---|---|---|
| JP | 63-184762 | 7/1988 |
| JP | 6-118700 | 4/1994 |
| JP | 7-191496 | 7/1995 |
| JP | 8-136439 | 5/1996 |
| JP | 2596563 | 4/1997 |
| JP | 11-295923 | 10/1999 |
| JP | 2000-56518 | 2/2000 |

* cited by examiner

*Primary Examiner*—John Goodrow
(74) *Attorney, Agent, or Firm*—Fitzpatrick, Cella, Harper & Scinto

(57) ABSTRACT

A toner is formed of toner particles each comprising at least a binder resin, a colorant and a wax, and inorganic fine powder. The toner is characterized by (a) containing a sulfur-containing polymer, and (b) showing dielectric loss tangent (tanδ) values at 100 kHz assuming a maximum of $2.5\times10^{-2}$ to $8\times10^{-2}$ in a temperature range of 100 to 130° C. Because of the combination of the features (a) and (b), the toner can exhibit a good combination of developing performances and fixing performances.

44 Claims, 4 Drawing Sheets

TONER, IMAGE FORMING METHOD AND PROCESS CARTRIDGE

FIELD OF THE INVENTION AND RELATED ART

The present invention relates to a toner for use in a recording method utilizing electrophotography, electrostatic recording, electrostatic printing, or toner jetting; and also an image forming method and a process cartridge using the toner.

In electrophotographic processes in general, an electrostatic image is formed by various means on a photosensitive member comprising a photoconductive substance and developed with a toner to form a toner image. The toner image is then transferred onto a transfer(-receiving) material, such as paper, and fixed by application of heat; pressure, or heat and pressure, or with solvent vapor to provide an image product, such as a print or a copy.

Development methods adopted in electrophotography, etc., are roughly divided into the dry development method and the wet development method, and the former is further divided into a method using a two-component developer and a method using a mono-component developer.

As toners used in the dry development methods, there have been used, e.g., fine particles of ca. 5–15 $\mu$m, each comprising a binder resin and a colorant dispersed therein. In a magnetic toner as a mono-component developer, fine particles of a magnetic material are used as a colorant. On the other hand, a two component developer generally comprises a mixture of a toner containing carbon black, pigment, etc. as a colorant with carrier particles, such as iron powder or ferrite particles.

For imparting a charge to toner particles, a charge control agent, such as a dye, a pigment or a polymeric compound, is added. Examples of positive charge control agent include: nigrosine dyes, azine dyes, copper phthalocyanine pigment, and quaternary ammonium salts, and examples of negative charge control agents include organic metal compounds of monoazo dyes, organic metal compounds of salicylic acid, naphtoic acid and dicarboxylic acids, and polymers having a sulfonic acid group. However, the addition of such a charge control agent alone does not provide improvements in all developing performances, inclusive of sufficient image density, prevention of fog, etc.

It has been considered that the developing performances of a toner and the dielectric loss tangent (tanδ) are closely related. This is also true with respect to a toner comprising a sulfur-containing polymer.

Japanese Laid-Open Patent Application (JP-A) 6-118700 has disclosed a toner having a specified ratio between a peak tanδ value in a high temperature region and a tanδ in a normal temperature region so as to reduce image defects, such as fog. Such an improvement is not necessarily achieved with respect to a toner comprising a sulfur-containing polymer.

JP-A 7-191496 has disclosed a styrene-acrylic resin having a specified dielectric loss tangent (tanδ) as a toner binder having improved toner image density stability and chargeability. Such an improvement is not necessarily achieved with respect to a toner comprising a sulfur-containing polymer.

Japanese Patent (JP-B) 2596563 has disclosed a toner having a dielectric loss tangent (tanδ) within a specific range as a toner showing a proper image density. Such an improvement is not necessarily achieved with respect to a toner comprising a sulfur-containing polymer.

JP-A 11-295923 has disclosed a toner having a dielectric loss tangent (tanδ) of a specific value or smaller as a toner capable of suppressing fog. Such an improvement is not necessarily achieved with respect to a toner comprising a sulfur-containing polymer.

JP-A 63-184762 has disclosed a toner containing a copolymer of a specific acrylamide-sulfonic acid monomer for providing a stable chargeability. JP-A 2000-56518 has disclosed at toner containing a copolymer of a sulfonic acid group-containing (meth)acrylamide having a specific glass transition temperature as a charge control agent for provide a toner showing a stable chargeability with little dependence on the environmental conditions. However, these proposals have failed to disclose an optimum range of dielectric loss tangent for such toners containing a sulfur-containing polymer.

SUMMARY OF THE INVENTION

A generic object of the present invention is to provide a toner having solved the above-mentioned problems.

A more specific object of the present invention is to provide a toner improved in fog suppression, stability and environmental-dependence of chargeability and quick chargeability.

Another object of the present invention is to provide toner showing good fog suppression, stable chargeability, and a good combination of fixability and anti-high temperature-offset characteristic.

Another object of the present invention is to provide a toner capable of exhibiting improved resistance to toner offsetting onto a fixing member and a cleaning member regardless of the heating scheme of fixing devices.

Still another object of the present invention is to provide a toner containing a sulfur-containing polymer showing good dispersibility in a binder resin and capable of exhibiting good charge increase characteristic in an initial stage of image formation (quick chargeability) regardless of environmental conditions.

Further objects of the present invention are to provide an image forming method and a process cartridge using such a toner as described above.

According to the present invention, there is provided a toner, comprising toner particles each comprising at least a binder resin, a colorant and a wax, and inorganic fine powder, wherein (a) the toner contains a sulfur-containing polymer, and (b) the toner shows dielectric loss tangent (tanδ) values at 100 kHz assuming a maximum of $2.5\times10^{-2}$ to $8\times10^{-2}$ in a temperature range of 100 to 130° C.

According to the present invention there is further provided an image forming method, comprising:

(i) a developing step of developing an electrostatic image held on an image-bearing member with a negatively chargeable toner to form a toner image thereon, (ii) a transfer step of transferring the toner image formed on the image-bearing member onto a recording material via or without via an intermediate transfer member, and (iii) a fixing step of heat-fixing the transferred toner image onto the recording material, wherein the negatively chargeable toner comprises toner particles each comprising at least a binder resin, a colorant and a wax, and inorganic fine powder, wherein (a) the toner contains a sulfur-containing polymer, and (b) the toner shows dielectric loss tangent (tanδ) values at 100 kHz assuming a maximum of $2.5\times10^{-2}$ to $8\times10^{-2}$ in a temperature range of 100 to 130° C.

The present invention further provides a process cartridge for use in an image forming apparatus of the type wherein an electrostatic image formed on an image-bearing member is developed with a toner transferred thereto to form a toner image and the toner image is transferred onto a recording material to form an image product, wherein the process cartridge comprises at least one member selected from the group consisting of the image-bearing member, a charging means for charging the image-bearing member, a latent image forming means for forming the electrostatic image on the image-bearing member, a transfer means for transferring the toner image on the image-bearing member onto a recording material and a cleaning means for removing transfer residual toner remaining on the image-bearing member remaining after the transfer of the toner image, and a developing means for developing the electrostatic image on the image-bearing member with the above-mentioned toner to form the toner image on the image-bearing member supported integrally with said at least one member to form a unit which is detachably mountable to the image forming apparatus.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
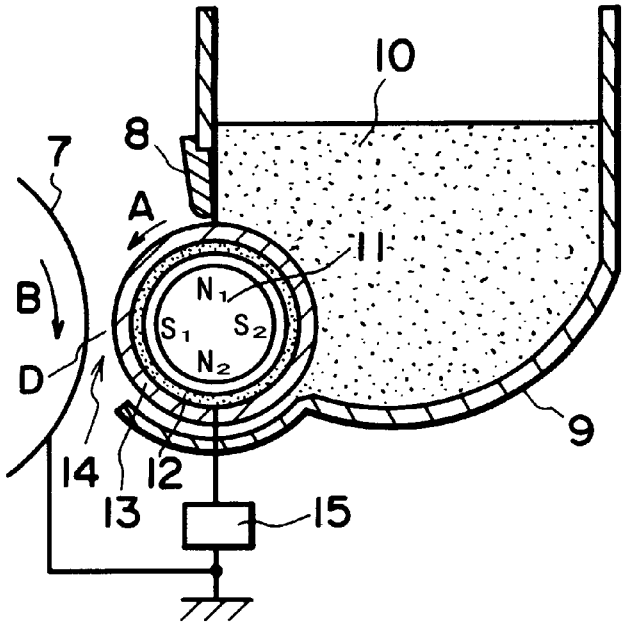
FIGS. 1 and 2 illustrate examples of developing apparatus suitable for using a toner of the invention, and using a magnetic toner layer-regulating blade and an elastic toner layer-regulating blade regulating blade, respectively.

We have arrived at the toner of the present invention based on a discovery that a toner containing a sulfur-containing polymer is caused to have improved developing performances inclusive of stable chargeability, quick chargeability and fog-preventing characteristic, and also an improved combination of fixability and anti-high-temperature offset characteristic, in case where the toner satisfies a specific dielectric loss tangent characteristic.

In the toner of the present invention, the sulfur-containing polymer is added principally as a charge control agent but also has a function of controlling the dispersion state of a colorant (particularly a magnetic material) and/or a wax contained in the toner so as to provide a dielectric loss tangent suitable for the present invention. The sulfur-containing polymer may be a polymer having a sulfonic acid group, preferably a polymer having polymerized units of an acrylamide-sulfonic acid derivative monomer, preferably an acrylamido-alkylsulfonic acid monomer, particularly 2-acrylamido-2-methylpropanesulfonic acid monomer, so as to more effectively exhibit the effect of controlling the dispersion state of the colorant (particularly a magnetic material) and the wax.

The toner may preferably contain the sulfur-containing polymer (or polymerized units of a sulfur-containing monomer in the case of forming a copolymer or a reaction product with another polymer as described hereinafter) in an amount of 0.01–20 wt. parts, more preferably 0.5–5 wt. parts, further preferably 0.7–2 wt. parts, per 100 wt. parts of the binder resin. The toner may contain sulfur atoms originated from the sulfur-containing polymer in a proportion of 20 ppm to 5 wt. %, preferably 50 ppm to 1 wt. %, further preferably 100 ppm to 0.5 wt. %. In any case where the sulfur-containing polymer content is below 0.01 wt. part or above 20 wt. parts per 100 wt. parts of the binder resin, or the sulfur content in the toner is below 20 ppm or above 5 wt. %, it becomes difficult for the sulfur-containing polymer to exhibit the effect of controlling the triboelectric chargeability of the toner as a charge control agent or controlling the wax dispersion state.

In the toner of the present invention, the sulfur-containing polymer may have a weight-average molecular weight (Mw) of $2\times10^3$ to $2\times10^5$, preferably $1.7\times10^4$ to $10^5$, further preferably $2.7\times10^4$ to $5\times10^4$. In case where the sulfur-containing polymer has a weight-average molecular weight (Mw) of below $2\times10^3$ or above $2\times10^5$, it is difficult for the sulfur-containing polymer to exhibit the effect of controlling the dispersion state of a colorant (particularly a magnetic material) or a wax.

In the toner of the present invention, the sulfur-containing polymer may have a glass transition temperature (Tg) of 30–120° C., preferably 50–100° C., further preferably 75–95° C. If the glass transition temperature (Tg) is below 30° C. or above 120° C., it is difficult for the sulfur-containing polymer to exhibit the effect of controlling the dispersion state of a colorant (particularly a magnetic material) or a wax.

In the toner of the present invention, the sulfur-containing polymer may assume a form of (i) a random copolymer an aromatic vinyl monomer and/or a (meth)acrylate ester monomer as a principal component and the sulfur-containing member, (ii) a block copolymer as represented by formula (3) below, or (iii) a reaction product of (iii) with a polyester:

$$R—X \qquad (3),$$

R denotes a polymer black principally comprising polymerized units of an aromatic vinyl monomer and/or a (meth) acrylate ester monomer, and X denotes a polymer block comprising polymerized units of a sulfonic acid group-containing monomer.

In the above, the aromatic vinyl monomer may preferably be styrene. The (meth)acrylate ester monomer includes an acrylate ester monomer and a methacrylate ester monomer, and preferred examples of the (meth)acrylate ester monomer may include: acrylate ester monomers, such as methyl acrylate, ethyl acrylate, propyl acrylate, butyl acrylate, 2-ethylhexyl acrylate, octyl acrylate, lauryl acrylate, and stearyl acrylate. It is particularly preferred that the polymer block R comprises a copolymer of styrene and 2-ethylhexyl acrylate or a copolymer of styrene and (n-)butyl acrylate. It is also possible to include a carboxylic group- or phosphoric acid group-containing monomer. The monomer composition may comprises 60–90 wt. %, preferably 65–85 wt. %, more preferably 70–80 wt. %, of styrene monomer, and 5–25 wt. %, preferably 7–22 wt. %, more preferably 10–20 wt. % of 2-ethylhexyl acrylate monomer or (n-)butyl acrylate monomer.

In case where the styrene monomer content is less than 60 wt. % and the (meth)acrylate ester monomer contact exceeds 25 wt. % or where the styrene monomer content exceeds 90 wt. % and the (meth)acrylate ester monomer content is below 5 wt. %, the uniform dispersion thereof in the binder resin is liable to be obstructed in some cases.

As mentioned above, the polymer represented by the above formula (3) can form a reaction product with a polyester, examples of which may include: a) a polymeric compound formed by by addition polymerization of an unsaturated polyester with the above-mentioned aromatic vinyl, (meth)acrylate ester monomer or a sulfonic acid group-containing monomer optionally further with a carboxyl acid group- or phosphoric acid group-containing monomer; b) a polymeric compound formed by reaction of a hydroxyl group of a polyester with a sulfonic acid group (and optionally further with a carboxylic acid group or a phosphoric acid group) of the polymer of the formula (3); c) a polymeric compound formed by reaction of a carboxylic acid group of a polyester with a hydroxyl group (if any) of the polymer of the formula (3); or a mixture of a)–c). The polymeric compound functioning as a charge control agent can contain 1–98 wt. % of such a reaction product with a polyester.

The polymer represented by the formula (3) may preferably be produced by polymerization between monomers providing the polymer block R and monomers providing the polymer block X in a weight ratio of 90:10 to 50:50, more preferably 85:15 to 55:45, further preferably 80:20 to 60:40. If the R block-providing monomers exceed 90 wt. %, it becomes difficult to impart a sufficient chargeability to the toner, and below 50 wt. %, the dispersion thereof within the binder resin is liable to be non-uniform.

The sulfur-containing polymer used in the toner of the present invention can be produced through various polymerization processes but may preferably be produced through bulk polymerization or solution polymerization using no or only a small amount of a polymerization solvent. Examples of such a polymerization solvent may include: methanol, ethanol, propanol, 2-propanol, propanone, 2-butanone and dioxane. It is also preferred to use a solvent mixture of methanol, 2-butanone and 2-propanol in weight ratios of 2:1:1 to 1:5:5.

The polymerization may be performed in the presence of a polymerization initiator, examples of which may include: t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 4,4'-azobis-4-cyanovaleric acid, 1,1'-azobis(cyanohexane-1-carbonitrile), 1,1'-di(t-butylperoxy)-3-methylcyclohexane, 1,1-bis(t-butylperoxy)-3,3,5-trimethylcyclohexane, 1,1'-di(t-butylperoxy)-3,3,5-trimethylcyclohexane, 1,1-bis(t-butylperoxy)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyl diperoxyisophthalate, 2,2-bis(4,4,-di-t-butylperoxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, and vinyltris(t-butylperoxy)silane. These initiators may be used singly or in combination. As preferred examples, 2,2'-azobis(2-methylbutyronitrile), 4,4'-azobis-4-cyanovaleric acid, 1,1'-di-(t-butylperoxy)-3-methylcyclohexane, and 1,1-bis(t-butylperoxy)-3,3,5-trimethylcyclohexane may be used singly or in combination, so as to provide a sulfur-containing polymer suitable for use in the toner of the present invention and minimizing the residual monomer content.

The polymer represented by the formula (3) may also be produced so as to localize the polymerized units of one monomer species (a kind of polymer block) in the copolymer chain by continuously supplying an appropriately selected composition of comonomers together with an propriately select solvent and utilizing a difference in copolymerization reactivity, or by utilizing a polymerization initiator having two or more peroxide groups or azo groups having different halflife temperatures while changing the monomer composition and polymerization temperature. The former process can result in polymer block compositions represented by R and X varying with the progress of the polymerization. This is however practically of no problem. The latter process may be preferable so as to provide a relatively low change in polymer block composition represented by R and X.

The toner of the present invention is characterized by a dielectric loss tangent (tanδ) characteristic as measured at a frequency of 100 Hz) showing a maximum ($\tan\delta_{max}$) of $2.5\times10^{-2}$ to $8\times10^{-2}$ in a temperature range of 100 to 130° C., preferably 100 to 125° C., and preferably with no peak in a temperature range of below 100° C. It is preferred that the maximum of tanδ in the temperature range of 100–130° C. is in the range of $3\times10^{-2}$ to $7\times10^{-2}$, further preferably $3.5\times10^{-2}$ to $6\times10^{-2}$, particularly preferably $3.5\times10^{-2}$ to $5.7\times10^{-2}$. In either case of $\tan\delta_{max}$ is below $2.5\times10^{-2}$ or above $8\times10^{-2}$, the toner is liable to result in image defects of image density lowering and fog on continuation of image formation due to impairment of stable chargeability.

On th other hand, according to my study, in order for a toner containing a sulfur-containing polymer to provide improved stability of chargeability, environment-dependence and quick chargeability while preventing the soiling of a fixing member due to soiling regardless of the fixing device heating scheme, it has been found the improvement in releasability from the fixing member is more critical than a conventional toner.

Hitherto, it has been considered that a common solution can be applied for the improvement in anti-offset effect and the improvement in fixability. However, the improvement in anti-offset problem is limited and insufficient as an ancillary effect accompanying the improvement in fixability by the improvement in the binder resin and wax contained in the toner.

Further, in case where the releasability of toner is insufficient even if the releasability of a fixing member and a cleaning member is improved, a sufficient offset prevention effect may be expected at an early stage of using these members, but these members can be gradually deteriorated with continuation of use to finally result in offset.

Hitherto, the use of a binder resin having an insoluble matter in an organic solvent, such as chloroform or THF, has been proposed as a means for improving the anti-hot offset characteristic. Such a toner is still liable to fail in exhibiting sufficient offset prevention effect when used together with a fixing member and a cleaning member which has been deteriorated as a result of continuation of use in a long term in some cases. Further, a wax has been used to provide a toner with a releasability, but a toner containing a large amount of wax so as to exhibit a sufficient anti-offset effect against used and deteriorated fixing member and cleaning member is liable to result in inferior developing performances, such as a lowering in image density and increased fog density on continuation of image formation. Further, in such a case, it becomes difficult to control the wax dispersion state in toner particles to result in an increased isolated wax in the toner. As a result, the cleaning of transfer residual toner on the photosensitive member is liable to be insufficient to result in image defects.

So as to continually exhibit a sufficient offset-prevention effect even used together with a fixing member and a cleaning member deteriorated as a result of continual use in years, the toner of the present invention should preferably show a specific range of contact angle with water More specifically, it is preferred that the toner of the present invention show a contact angle with water of 105 to 130 deg., more preferably 107 to 127 deg., further preferably 110 to 125 deg. If the contact angle is below 105 deg., it becomes difficult to retain a sufficient anti-offset effect when used in combination with long-used fixing member and cleaning member. On the other hand, if the contact angle exceeds 130 deg., the toner is liable to be accompanied with difficulties in developing performance and cleanability on the photosensitive member.

According to my study, it has been found possible to provide a toner having such a contact angle characteristic as described above by using a binder resin having a specific acid value, a specific organometalic compound as a crosslinking agent and a wax having a specific structure and peak molecular weight.

More specifically, the above-mentioned contact angle characteristic may suitably be accomplished on condition that the toner and the binder resin have specific acid values. The binder resin contains a specific level of tetrahydrofuran (THF)-insoluble matter, and also a THF-soluble matter showing a main peak in a specific molecular weight region and a sub-peak and/or a shoulder in a different molecular weight region, and the toner contains a specific organic aluminum compound or organic iron compound together with the sulfur-containing polymer.

More specifically, the toner of the present invention may preferably have a specific acid value as principally given by a non-esterified acid group, such as a carboxyl group, of the binder resin, so that the binder resin may also have an acid value.

In the case where the toner contains an organometalic compound as a charge control agent, the acid group of the binder resin functions to form a THF-insoluble matter by an interaction with the organometallic compound in the melt-kneading step for toner production. Depending on the melt-kneading condition, the toner an contain a THF-soluble matter giving a sub-peak and/or a shoulder in a molecular weight region of $1.5\times10^6$ to $8\times10^7$ on a GPC chromatogram in addition to the THF-insoluble matter.

It is preferred that the toner of the present invention shows an acid value of 1–40 mgKOH/g, more preferably 5–30 mgKOH/g, further preferably 10–20 mgKOH/g. If the toner acid value is below 1 mgKOH/g or above 40 mgKOH/g, the dispersion state of the sulfur-containing polymer or wax is liable to be inadequate to result in a lowering in image density in continuous image formation.

In the toner of the present invention, the binder resin may have an acid value of 1–40 mgKOH/g, preferably 5–30 mgKOH/g, further preferably 10–20 mgKOH/g.

In the toner of the present invention, it is preferred that the binder resin contained in toner particles contain a 1–50 wt. %, more preferably 5–40 wt. %, further preferably 10–30 wt. % of THF-insoluble matter. In either case of the THF-insoluble content being below 1 wt. %, or above 50 wt. %, it becomes difficult to retain a good dispersion state of the sulfur-containing polymer and wax, thus being liable to result in toner attachment onto the fixing member during continual image formation.

It is preferred that the binder resin contains at least 50 wt. %, more preferably at least 60 wt. %, further preferably at least 70 wt. % of polyester. If the polyester content is below 50 wt. %, it becomes difficult to retain a good dispersion state of the sulfur-containing polymer in the toner particles, thus being liable to result in an image density lowering in some cases.

In the case where the binder resin contained in the toner particles contains 50 wt. % or more of polyester, the THF-soluble matter in the toner particles may preferably have such a molecular weight distribution as to provide a GPC chromatogram showing a peak in a molecular weight region of $2\times10^3$–$1.5\times10^4$ and a content of 0.5–15% in a molecular weight region of at least $10^5$ and below $10^7$; more preferably a peak in a molecular weight region of $4\times10^3$–$1.2\times10^4$ and a content of 1–13% in the molecular weight region of at least $10^5$ and below $10^7$; further preferably a main peak in a molecular weight region of $6\times10^3$–$10^4$ and a content of 2–10% in the molecular weight region of at least $10^5$ and below $10^7$. In any case where a main peak is present in a molecular weight region of below $2\times10^3$ or above $1.5\times10^4$, or the content in the molecular weight region of $10^5$ to below $10^7$ is below 0.5% or above 15%, it becomes difficult to retain a good dispersion state of the sulfur-containing polymer or the wax in the toner, thus being liable to result in an image density lowering in continual image formation.

In the case where the binder resin in the toner particles comprises a vinyl polymer, the THF-soluble matter in the toner particles may preferably have such a molecular weight distribution as to provide a GPC chromatogram showing a peak in a molecular weight region of $3\times10^3$–$3\times10^4$ and a sub-peak and or shoulder in a molecular weight region of $2\times10^5$–$1.5\times10^7$; more preferably a peak in a molecular weight region of $7\times10^3$–$2.5\times10^4$ and a sub-peak and/or a shoulder in a molecular weight region of $3\times10^5$–$1.2\times10^6$; further preferably a peak in a molecular weight region of $9\times10^3$–$2\times10^4$ and a sub-peak and/or a shoulder in a molecular weight region of $4\times10^5$–$10^6$. In any case where a peak is present in a molecular weight region of below $3\times10^3$ or above $3\times10^4$; a peak is not present in the molecular weight region of $3\times10^3$–$3\times10^4$ and a sub-peak and/or a shoulder is present in the molecular weight region of below $2\times10^5$ or above $1.5\times10^6$; or no sub-peak or shoulder is present in the molecular weight region of $2\times10^6$–$1.5\times10^7$, it becomes difficult to retain a good dispersion state of the sulfur-containing polymer or the wax in the toner, thus being liable to result in an image density lowering in continual image formation.

In the toner of the present invention, it is possible to add an organo-aluminum compound and/or an organo-iron compound as a charge control agent.

Herein, the organo-aluminum compound refers to any of compounds, such as organo-aluminum complex compounds (inclusive of complexes and complex salts) and organic aluminum salts, formed by reaction of an aluminum compound with an aromatic diol, an aromatic hydroxycarboxylic acid, an aromatic monocarboxylic acid or an aromatic polycarboxylic acid. A preferred example thereof is an organo-aluminum compound comprising two mols of 3,5-di-t-butylsalicylic acid and one mol of aluminum element. Such an organo-aluminum compound may be contained in an amount of 0.02–2 wt. %, preferably 0.05–1.5 wt. %, further preferably 0.1–1 wt. %, as aluminum, based on the toner. Below 0.02 wt. %, the anti-offset property of the toner is liable to be insufficient, and in excess of 2 wt. %, the low-temperature fixability of the toner is liable to be inferior.

The organo-iron compound refers to a reaction product of a monoazo compound and an iron compound and may be contained in an amount of 0.02–2 wt. %, preferably 0.05–1.5 wt. %, further preferably 0.1–1 wt. %, as iron, based on th toner. Below 0.02 wt. %, the image density stability of the toner in a high temperature/high humidity environment is liable to be problematic, and in excess of 2 wt. %, the image density stability of the toner in normal temperature/low humidity environment is liable to be problematic.

The toner of the present invention may preferably contain a THF-insoluble matter which is presumably formed through an interaction of an organo-aluminum compound or organi-iron compound and a carboxyl group of the binder resin, i.e., a kind of complex-forming reaction assumed to be a ligand-exchange reaction, in the melt-kneading step for toner production, but the control of resultant THF-insoluble matter content in the reaction has been difficult so far. In the case of the co-presence of the sulfur-containing polymer in the present invention, however, it has become possible to control the resultant THF-insoluble matter content and provide a dispersion state of the wax suitable for the toner of the present invention presumably through a synergistic effect of the organo-metal compound, the binder resin and the sulfur-containing polymer. In this case, it is presumed that the metal is not present as a metal complex or complex salt wherein the aromatic diol, aromatic hydroxycarboxylic acid or aromatic carboxylic acid is coordinated as a ligand.

The wax contained in the toner of the present invention may preferably have a main peak in a molecular weight region of 300–20000 and a ratio (Mw/Mn) of 1.0–20; more preferably a main peak in a molecular weight region of 500–10000 and a ration (Mw/Mn) of 1.1–18; further preferably a main peak in a molecular weight region of 700–5000 and a ratio (Mw/Mn) of 1.2 to 15. If the main peak molecular weight is below 300, the wax dispersion particle size in the toner particles is liable to be excessively small, and if the main peak molecular weight exceeds 20000 or the ratio (Mw/Mn) exceeds 20, the wax dispersion particle size is liable to be excessively large, thus making difficult the wax dispersion.

The wax used in the toner of the present invention may preferably exhibit such a thermal behavior as to provide a DSC (differential scanning calorimetry) curve of a toner containing the wax showing a heat-absorption main peak in a temperature region of 70–150° C., preferably 75–130° C., further preferably 80–110° C., and also a heat-absorption sub-peak or shoulder. In case where the heat-absorption main peak is present outside the temperature region of 70–150° C., it becomes difficult to satisfy the low-temperature fixability, anti-hot-offset characteristic and anti-blocking property in combination.

The toner of the present invention can contain two or more species of waxes. In this case, the waxes may provide a main peak in a molecular weight region of 300–20000, and a ratio (Mw/Mn) of 1.2–25; preferably a main peak in a molecular weight region of 350–10000 and a ratio (Mw/Mn) of 1.5–20; further preferably a main peak in a molecular weight region of 400–5000 and a ratio (Mw/Mn) of 2–10. In either case where the main peak molecular weight is below 300 and the ratio (Mw/Mn) is below 1.2, or the main peak molecular weight is above 20000 and the ratio (Mw/Mn) is above 25, it becomes difficult to control the wax dispersion state in the toner particles.

The toner used in the present invention may be selected from hydrocarbon waxes, polyethylene waxes, and polypropylene waxes.

The wax used in the present invention may preferably comprise a synthetic hydrocarbon wax obtained from a distillation residue of hydrocarbons synthesized from carbon monoxide and hydrogen through the Arge process, or from hydrogenation product of the distillation residue. It is further preferred to use such hydrocarbon waxes after fractionation by press-sweating, solvent processing, vacuum distillation or fractional crystallization.

The wax used in the toner of the present invention may have a structure referenced by formula (1) below:

$$CH_3—(CH_2—CH_2)_x—CH_2—CH_2—A \quad (1),$$

wherein A denotes a hydroxyl group or a carboxyl group, preferably a hydroxyl group, and and x is an integer of 20 to 60, preferably 30 to 50.

The wax used in the present invention may have a form of acid-modified polyethylene or polypropylene having an acid value of 1–2 mgKOH/g, preferably 1.5–15 mgKOH/g, obtained through modification with maleic acid, maleic acid half ester or maleic anhydride.

In case where the wax used in the present invention comprises two or more species, at least one of which should preferably be selected from the above-mentioned wax species.

In the tone production process, the wax can be added and dispersed in the melt-kneading step but may preferably be added in the binder resin production step so as to further facilitate the control of wax dispersion state.

In the case where two or more species of waxes are contained in the toner of the present invention, it is preferred to add at least one species of waxes selected from hydrocarbon wax, polyethylene wax, polypropylene wax, acid-modified polyethylene wax having an acid value (Av) of 1–20 mgKOH/g, and acid-modified polypropylene wax having an acid value (Av) of 1 to 20 mgKOH/g, in the binder resin production step.

Preferred examples of combination of two wax species when mixed in equal weights are shown in Table 1 below.

TABLE 1

| Ex. | Low-molecular weight wax | High-molecular weight wax | Mixture wax |
|---|---|---|---|
| (1) | Hydrocarbon wax (Mp = 1000, Mw/Mn = 1.5, $T_{abp}$ = ca.105° C.) | Polypropylene wax (Mp = 3000, Mw/Mn = ca.9, $T_{abp}$ = ca.145° C.) | Mp = 1000 Mw/Mn = 9.1 |
| (2) | Wax of formula (1) (A = OH) (Mp = 800, Mw/Mn = 2.0, $T_{abp}$ = ca.100° C.) | Polypropylene wax (Mp = 3000, Mw/Mn = ca.9, $T_{abp}$ = ca.105° C.) | Mp 800 Mw/Mn = 9.3 |
| (3) | Wax of formula (1) (A = OH) (Mp = 800, Mw/Mn = 2.0, $T_{abp}$ = ca.100° C.) | Hydrocarbon wax (Mp = 1000, Mw/Mn = 1.5, $T_{abp}$ = ca.105° C.) | Mp = 800 Mw/Mn = 2.2 |
| (4) | Paraffin wax (Mp = 500, Mw/Mn = 1.3, $T_{abp}$ = ca.80° C.) | Hydrocarbon wax (Mp = 1000, Mw/Mn = 1.5, $T_{abp}$ = ca.105° C.) | Mp = 500 Mw/Mn = 1.6 |

TABLE 1-continued

| Ex. | Low-molecular weight wax | High-molecular weight wax | Mixture wax |
|---|---|---|---|
| (5) | Paraffin wax (Mp = 500, Mw/Mn = 1.3, $T_{abp}$ = ca.80° C.) | Polypropylene wax (Mp = 3000, Mw/Mn = ca.9, $T_{abp}$ = ca.145° C.) | Mp = 500 Mw/Mn = 8.7 |
| (6) | Paraffin wax (Mp = 500, Mw/Mn = 1.3, $T_{abp}$ = ca.80° C.) | Wax of formula (1) (A = OH) (Mp = 800, Mw/Mn = 2.0, $T_{abp}$ = ca.100° C.) | Mp = 500 Mw/Mn = 1.7 |

In the above Table 1,
Mp: mainpeak-molecular weight,
$T_{abp}$ = heat-absorption peak temperature.

In case where a vinyl polymer is used as (a part of) the binder resin, the vinyl polymer may preferably be a styrene copolymer. Examples of comonomer to be copolymerized with styrene may include: styrene derivatives, such as vinyltoluene; acrylic acid; acrylates, such as methyl acrylate, ethyl acrylate, butyl acrylate, dodecyl acrylate, octyl acrylate, 2-ethylhexyl acrylate, and phenyl acrylate; methacrylic acid; methacrylates, such as methyl methacrylate, ethyl methacrylate, butyl methacrylate, dodecyl methacrylate, octyl methacrylate, 2-ethylhexyl methacrylate and phenyl methacrylate; unsaturated dicarboxylic acids and mono- or di-esters thereof, such as maleic acid, maleic anhydride, monobutyl maleate, methyl maleate and dimethyl maleate; acrylamide, methacrylamide, acrylonitrile, methacrylonitrile; butadiene; vinyl chloride, vinyl acetate, vinyl benzoate; ethylenic olefins, such as ethylene, propylene and butylene; vinyl ketones, such as vinyl methyl ketone and vinyl hexyl ketone; and vinyl ethers, such as vinyl methyl ether, vinyl ethyl ether and vinyl isobutyl ether. These vinyl monomers may be used singly or in mixture of two or more species.

The vinyl polymerization may be performed in the presence of a polymerization initiator, examples of which may include t-butyl peroxy-2-ethylhexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 4,4'-azobis-4-cyanovaleric acid, 1,1'-azobis(cyanohexane-1-carbonitrile), 1,1'-di(t-butylperoxy)-3-methylcyclohexane, 1,1-bis(t-butylperoxy)-3,3,5-trimethylcyclohexane, 1,1'-di(t-butylperoxy)-3,3,5-trimethylcyclohexane, 1,1-bis(t-butylperoxy)cyclohexane, 2,2-bis(t-butylperoxy)octane, n-butyl-4,4-bis(t-butylperoxy)valerate, 2,2-bis(t-butylperoxy)butane, 1,3-bis(t-butylperoxyisopropyl)benzene, 2,5-dimethyl-2,5-di(t-butylperoxy)hexane, 2,5-dimethyl-2,5-di(benzoylperoxy)hexane, di-t-butyl diperoxyisophthalate, 2,2-bis(4,4,-di-t-butyl-peroxycyclohexyl)propane, di-t-butyl peroxy-α-methylsuccinate, di-t-butyl peroxydimethylglutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, and vinyltris(t-butylperoxy)silane. These initiators may be used singly or in combination.

The polyester as a binder resin (component) may be produced from monomers as described below.

Diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (4) and diols represented by a formula (5) below:

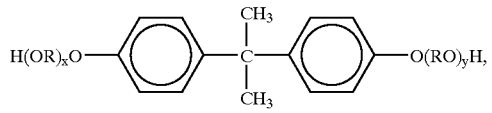

(4)

wherein R denotes an ethylene or propylene group, x and y are independently an integer of at least 1 with the proviso that the average of x+y is in the range of 2–10;

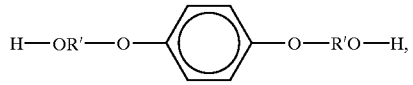

(5)

wherein R' denotes an ethylene, propylene or tert-butylene group.

Examples of acid components may include benzenedicarboxylic acids, such as phthalic acid, isophthalic acid and terephthalic acid, and their anhydrides; alkyldicarboxylic acids, such as succinic acid, adipic acid, sebacic acid and azelaic acid, and their anhydrides; $C_6$–$C_{18}$ alkyl- or alkenyl-substituted succinic acids, and their anhydrides; and unsaturated dicarboxylic acids, such as fumaric acid, maleic acid, citraconic acid and itaconic acid, and their anhydrides.

In the case of providing a magnetic toner, a magnetic material is used also functioning as a colorant. The magnetic material may comprise a magnetic oxide, such as magnetite, maghemite or ferrite, and more preferably a magnetic iron oxide containing a non-iron element or a mixture thereof.

Examples of the non-iron element may include: lithium, beryllium, boron, magnesium, aluminum, silicon, phosphorus, sulfur, germanium, titanium, zirconium, tin, lead, zinc, calcium, barium, chromium, manganese, cobalt. copper, nickel, gallium, indium, silver, palladium, gold, platinum, tungsten, molybdenum, niobium, osmium, strontium, yttrium technetium, ruthenium, rhodium and bismuth. Preferred examples include: lithium, beryllium, boron, magnesium, aluminum, silicon, phosphorus, germanium, titanium, zirconium, tin, sulfur, calcium, barium, vanadium, chromium, manganese, cobalt, copper, nickel, strontium, bismuth and zinc. It is particularly preferred to use a magnetic iron oxide containing a non-iron element selected from magnesium, aluminum, silicon, phosphorus and zirconium. Such a non-iron element may be incorporated in the iron oxide crystal lattice, may be incorporated in the form of an oxide thereof in the iron oxide or may be present as an oxide or a hydroxide at the surface of magnetic iron oxide particles. It is preferred that the non-iron element is contained in the form of an oxide thereof.

Such a non-iron element can be incorporated in the magnetic particles by pH adjustment of an aqueous system for producing the magnetic material also containing a salt of the non-iron element. The precipitation of such a non-iron element on the magnetic particles can be effected by pH adjustment or a combination of addition of a salt of the element and pH adjustment, after formation of the magnetic particles.

A magnetic material containing such a non-iron element generally shows a good affinity with a toner binder resin, particularly with a toner binder resin having a specific acid value, and advantageously affects the dispersion of a charge control agent in a suitable state. Further, such a magnetic material can be formed in a narrow particle size distribution and is well dispersed in the binder resin, to result in a toner having improved uniformity and stability of chargeability.

Such a non-iron element may preferably be contained in a proportion of 0.05–10 wt. %, more preferably 0.1–7 wt. %, further preferably 0.2–5 wt. %, particularly preferably 0.3–4 wt. %, based on the iron (element) in the magnetic iron oxide. Below 0.05 wt. %, the effects of the element addition become scarce, thus being liable to fail in providing good dispersibility and uniform chargeability. Above 10 wt. %, the charge liberation is increased to result in an insufficient charge which leads to lower image density and increased fog.

Such a non-iron element may preferably be dominantly present in proximity to the surface of the magnetic particles. More specifically, it is preferred that 20–100 wt. %, more preferably 25–100 wt. % of the non-iron element is dissolved at a point of 20 wt. % dissolution of the iron in the iron oxide. By the dominant presence near the magnetic particle surface of the non-iron element, it is possible to enhance the dispersion effect and the electrical diffusion effect.

The magnetic material may preferably have a number-average particle size (D1) of 0.05–1.0 $\mu$m, more preferably 0.1–0.5 $\mu$m. The magnetic material may preferably have a BET specific surface area ($S_{BET}$) of 2–40 $m^2/g$, more preferably 4–20 $m^2/g$. The magnetic material may preferably have magnetic properties including a saturation magnetization of 10–200 $Am^2/kg$, more preferably 70–100 $Am^2/kg$, as measured at a magnetic field of 795.8 kA/m; a residual magnetization of 1–100 $Am^2/kg$, more preferably 2–20 $Am^2/kg$, and a coercive force of 1–30 kA/m, more preferably 2–15 kA/m. The magnetic material may be added in an amount of 20–200 wt. parts per 100 wt. parts of the binder resin.

In the case of providing a non-magnetic toner, arbitrary pigments or dyes may be added. Examples of the pigment may include: carbon black, aniline black, acetylene black, Naphthol Yellow, Hansa Yellow, Rohdamine Yellow, Alizarin Yellow, red iron oxide, and Phthalocyanine Blue. The pigment may be used in an amount for providing a sufficient optical density, e.g., 0.1–20 wt. parts, preferably 0.2–10 wt. parts, per 100 wt. parts of the binder resin. For a similar purpose, a dye can be used. Examples thereof may include: azo dyes, anthraquinone dyes, xanthene dyes and methine dyes. The dye may be used in 0.1–20 wt. parts, preferably 0.3–10 wt. parts, per 100 wt. parts of the binder resin.

According to my study, in the toner containing a sulfur-containing polymer, the dispersion states, such as dispersed particle sizes and their distribution, of the sulfur-containing polymer in the binder resin affects the pulverizability into toner particles during toner production and favorably affects the formation of spherical toner particles represented by a circularity without resorting to particular pulverization means, such as a mechanical pulverizer or a pneumatic pulverizer.

In the toner of the present invention, the toner particles may contain 55 to 90% by number, preferably 57 to 85% by number, further preferably 60 to 80% by number of particles having a circularity Ci calculated by formula (2) shown below of at least 0.950, $$\text{Circularity } Ci = L_0/L \quad (2),$$

wherein L represents a peripheral length of a projection image (two dimensional image) of an individual toner particle, and $L_0$ represents a peripheral length of a circle giving an identical area as the projection image.

In the toner of the present invention, in either case where the toner particles having Ci≧0.950 occupy below 55% by number or above 90% by number, the toner is liable to suffer from a charging failure which may be attributable to inadequate dispersion state of the sulfur-containing polymer at or close to the toner particle surface particularly affecting the toner chargeability.

The toner of the present invention may have such a particle size distribution as to provide a weight-average particle size (D4) of 4–12 $\mu$m and a volume-basis content of particles of 10.1 $\mu$m (V % (≧10.1 $\mu$m)) of at most 70%; preferably D=5–9 $\mu$m and V % (≧10.1 $\mu$m)<40%, further preferably D4=5.5–8 $\mu$m and V % (≧10.1 $\mu$m)<20%. In case of D4>12 $\mu$m or V % (≧10.1%)>70%, the chargeability is liable to be ununiform.

Such toner particles constituting the toner of the present invention may preferably be produced through a process wherein the above-mentioned toner ingredients including the binder resin, the colorant and the wax are sufficiently blended by means of a ball mill, a Henschel mixer, etc. and then melt-kneaded by hot kneading means, such as a hot roller kneader or an extruder, and after being solidified by cooling, the melt-kneaded product is coarsely crushed and finely pulverized by the action of a jet stream or mechanically, followed by classification, to recover toner particles. Other production processes may include a polymerization toner production process wherein prescribed ingredients are blended with a monomer constituting the binder resin, and the resultant polymerizable mixture is suspended in an aqueous medium and polymerized to form toner particles; a microencapsule toner production process wherein prescribed ingredients are incorporated in ether one or both of the core material and the shell material; and a spray drying process wherein a dispersion of prescribed ingredients in a binder resin solution is spray-dried to form toner particles. The thus-obtained toner particles are optionally blended with external additives as mentioned below by a blender, such as a Henschel mixer to obtain a toner of the present invention.

The toner of the present invention may contain a flowability-improving agent externally added to toner particles. Examples thereof may include: fine powders of fluorine-containing resins, such as polyvinylidene fluoride and polytetrafluoroethylene; fine powders of inorganic oxides such as wet-process silica, dry-process silica, titanium oxide and alumina, and surface-treated products of these inorganic oxide fine powders treated with silane compounds, titanate coupling agents and silicone oil.

It is preferred to use a so-called dry-process silica or fumed silica, which is fine powdery silica formed by vapor-phase oxidation of a silicone halide, e.g., silicon tetrachloride. The basic reaction may be represented by the following scheme:

$$SiCl_4+2H_2+O_2 \rightarrow SiO_2+4HCl.$$

In the reaction step, another metal halide, such as aluminum chloride or titanium, can be used together with the silicon halide to provide complex fine powder of silica and another metal oxide, which can be also used as a type of silica as a preferred flowability-improving agent to be used in the toner of the present invention. The flowability-improving agent may preferably have an average primary particle size of 0.001–2 $\mu$m, more preferably 0.002–0.2 $\mu$m.

Examples of commercially available silica fine powder products formed by vapor-phase oxidation of silicon halides may include those available under the following trade names.

"AEROSIL" 130, 200, 300, 380, TT600, MOX170, MOX80, COK84 (available from Nippon Aerosil K.K.); "Ca-O-SiL" M-5, MS-7, MS-75, HS-5, and EH-5 (available from Wacker-Chemie GMBH); D-C Fine Silica (available from Dow Corning Co.); and Fransol (available from Fransil Co.).

It is further preferred to use such silica fine powder after a hydrophobization treatment.

The hydrophobization may be effected by treating the silica fine powder with an organosilicon compound reactive with or physically adsorbed by the silica fine powder.

Examples of the organosilicon compound may include: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans such as trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylsiloxanes having 2–12 siloxane units per molecule including terminal units each having one hydroxyl group connected to Si; and further silicone oils, such as dimethylsilicone oil. These organosilicon compounds may be used singly, or in mixture, or in succession of two or more species.

The flowability-improving agent may preferably have a methanol wettability of at least 30%, more preferably at least 50%, and also have a specific surface area as measured by the BET method using nitrogen adsorption ($S_{BET}$) of at least 30 $m^2/g$, more preferably at least 50 $m^2/g$. The flowability-improving agent may preferably be used in a proportion of 0.01–8 wt. parts, more preferably 0.1–4 wt. parts, per 100 wt. parts of the toner.

The toner of the present invention can contain various additives, in addition to the flowability-improving agent, for imparting various properties. Examples of such additives may include the following.

(1) Abrasives, inclusive of: metal oxides, such as strontium titanate, cerium oxide, aluminum oxide, magnesium oxide and chromium oxide; nitrides, such as silicon nitride; carbides, such as silicon carbide; metal salts, such as calcium sulfate, barium sulfate and calcium carbonate.

(2) Lubricants, inclusive of: powders of fluorine-containing resins, such as polyvinylidene fluoride and polytetrafluoroethylene; and fatty acid metal salts, such as zinc stearate and calcium stearate.

(3) Charge-controlling particles, inclusive of: particles of metal oxides, such as tin oxide, titanium oxide, zinc oxide, silicon oxide, and aluminum oxide; carbon black, and resin particles.

These additives may be added in an amount of 0.05–10 wt. parts, preferably 0.1–5 wt. parts, per 100 wt. parts of the toner particles. These additives may be used singly or in combination of two or more species.

In the case of providing a magnetic toner, it is preferred to add two or species of additives in combination in view of the stability of continuous developing performance and the stability of developing performance after standing. In the case of providing a non-magnetic monocomponent developer, it is preferred to use titanium oxide or alumina in view of the improved flowability and image uniformity.

The toner of the present invention can also be blended with a carrier to provide a two-component developer. The carrier may preferably have a resistivity of $10^6$–$10^{10}$ ohm.cm adjusted, e.g., by controlling the surface unevenness of carrier particles and the amount of a surface-coating resin.

Example of the surface-coating resin may include: styrene-acrylate copolymers, styrene-methacrylate copolymers, acrylate ester copolymers, methacrylate ester copolymers, silicone resin, fluorine-containing resin, polyamide resin, ionomer resin, polyphenylene sulfide resin, and mixture of these resins.

The carrier core may comprise a magnetic material, examples of which may include: oxides, such as ferrite, iron-excessive ferrite, magnetite and gamma-iron oxide; metals, such as iron, cobalt and nickel, and alloys of these metals. These magnetic materials can further contain other elements, such as iron, cobalt, nickel, aluminum, copper, lead, magnesium, tin, zinc, antimony, beryllium, bismuth, calcium, manganese, selenium, titanate, tungsten, and vanadium.

Next, some image forming methods wherein the toner of the present invention is suitably used, will be described.

First, developing means (apparatus) applicable to the image forming method of the present invention will be explained.

Referring to FIG. 1, an electrophotographic photosensitive drum 7 (as an example of an image-bearing member for bearing an electrostatic latent image formed by a known process) is rotated in a direction of arrow B. On the other hand, a developing sleeve 14 (as a developer-carrying member) carrying a toner 10 (as a mono-component developer) supplied from a hopper 9 is rotated in a direction of arrow A to convey a layer of the toner 10 to a developing region D where the developing sleeve 14 and the photosensitive drum 7 oppose each other. In case where the toner 10 is a magnetic toner, a magnet 11 is disposed within the developing sleeve so as to magnetically attract and hold the magnetic toner 10 on the developing sleeve, whereby the toner is subjected to friction with the developing sleeve 14 to acquire a triboelectric charge sufficient for developing an electrostatic latent image on the photosensitive drum 7.

In order to regulate the layer thickness of the magnetic toner 10 supplied to the developing region, a regulating magnetic blade 8 comprising a ferromagnetic metal is hung down from the hopper 9 to confront the developing sleeve 14 with a gap of ca. 200–300 μm from the surface of the developing sleeve 14. Lines of magnetic induction from a magnetic pole $N_1$ of the magnet 11 are concentrated to the blade 8, whereby a thin layer of the toner 10 is formed on the developing sleeve 14. The blade 8 can also comprise a non-magnetic blade. Further, in case where the toner 10 is a non-magnetic toner, the blade 8 may be an elastic blade comprising urethane rubber, silicone rubber, tip blade, etc.

The thin layer thickness of the toner 10 formed on the developing sleeve 14 may preferably be smaller than the minimum gap between the developing sleeve 14 and the photosensitive drum 7 at the developing region D. The image forming method according to the present invention is particularly effective in such a developing apparatus for the scheme wherein an electrostatic latent image is developed with such a thin layer of toner, i.e., a non-contact type developing apparatus. However, the image forming method according to the present invention is also applicable to a developing apparatus wherein the toner layer thickness is larger than the minimum gap between the developing sleeve 14 and the photosensitive drum 7 at the developing region, i.e., a contact-type developing apparatus.

Hereinbelow, further description of a non-contact type developing apparatus will be made.

Referring again to FIG. 1, the developing sleeve 14 is supplied with a developing bias voltage from a power supply 15 so as to cause a jumping of a toner 10 (as a mono-component developer) carried on the developing sleeve 14. In case where the developing bias voltage is a DC voltage, it is preferred that the developing sleeve 14 is supplied with a developing bias voltage which is equal to a voltage given as a difference between a potential of an image region (where the toner 10 is attached to provide a visual image region) and a potential of a background region of an electrostatic latent image. On the other hand, in order to increase the density or gradational characteristic of a developed image, it is also possible to apply an alternating bias voltage to the developing sleeve 14, thereby forming a vibrating field of which the voltage polarity alternates with time at the developing region D. In this case, it is preferred that the developing sleeve 14 is supplied with an alternating bias voltage superposed with a DC voltage component equal to the above-mentioned difference between the image region potential and the background region potential.

Further, in the case of so-called normal development scheme wherein a toner is attached to a higher potential region of an electrostatic latent image having such a higher-potential region and a lower potential region, a toner charged to a polarity opposite to that of the electrostatic latent image is used. On the other hand, in the case of the reversal development scheme wherein a toner is attached to a lower-potential region of an electrostatic latent image, a toner charged to a polarity identical to that of the electrostatic latent image is used. Herein, a higher-potential and a lower-potential refers to potential in terms of absolute value. In any case, the toner 10 is triboelectrically charged due to friction between the toner 10 and the developing sleeve 14 to a polarity appropriate for developing an electrostatic latent image on the photosensitive drum 7.

Figure 2:
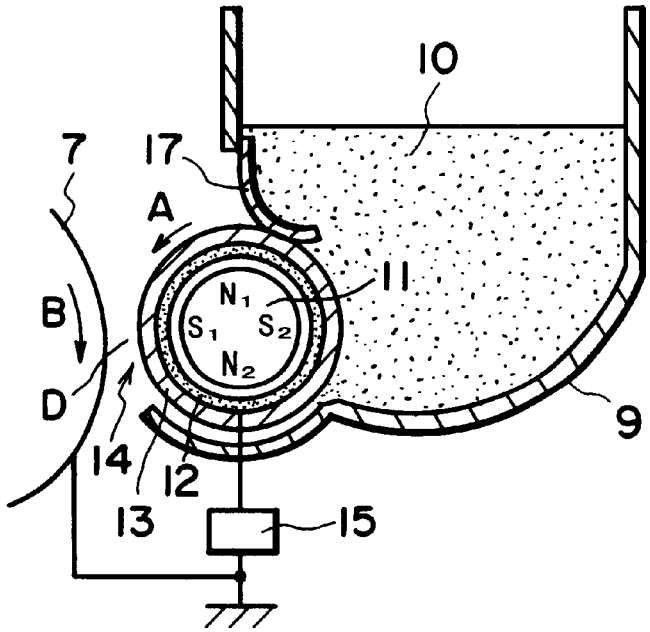

In a developing apparatus shown in FIG. 2, an elastic plate 17 comprising a material having a rubber elasticity, such as urethane rubber or silicone rubber, or a material having a metal elasticity, such as phosphor bronze or stainless steel, is used as a member for regulating the layer thickness of toner 10 on a developing sleeve 14, and the elastic plate 17 is pressed against the developing sleeve 14. In such a developing apparatus, a further thin toner layer can be formed on the developing sleeve 14. The other structure of the developing apparatus shown in FIG. 2 is basically identical to that of the apparatus shown in FIG. 1, and identical numerals in FIG. 2 represent identical members as in FIG. 1.

In the developing apparatus of FIG. 2, the toner is applied by rubbing with the elastic plate 17 onto the developing sleeve 14 to form a toner layer thereon, so that the toner can be provided with a larger triboelectric charge and thus results in a higher image density. This type of developing apparatus is used for a non-magnetic mono-component toner.

Figure 3:
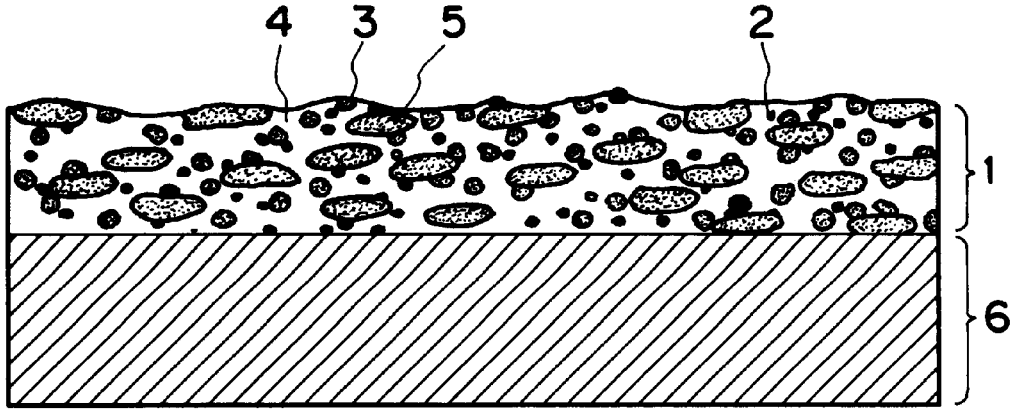
FIG. 3 is a schematic partial sectional view of an example of developer-carrying member suitable for carrying a toner of the invention.

The developing sleeve used as a developer-carrying member in the present invention may preferably comprise a cylindrical substrate and a resinous coating layer coating the substrate surface. An example of such a structure is illustrated in FIG. 3 which is a partial sectional view of the sleeve. Referring to FIG. 3, a cylindrical substrate 6 is coated with a resinous coating layer 1 which may comprise a binder resin 4 and optionally an electroconductive substance 2, a filler 3, a solid lubricant 5, etc., as desired. In case where the electroconductive substance 2 is contained, the resin coating layer 1 becomes electroconductive. This is effective for preventing excessive charge of the toner. In case where the filler 3 is contained, the wearing of the resin coating layer 1 may be suppressed, and the toner charge can be suitably controlled by the charge-imparting ability of the filler 3. Further, in the case where the solid lubricant 5 is contained, the releasability between the toner and the developing sleeve can be improved, thereby preventing melt-sticking of the toner onto the developing sleeve.

In the case of incorporating an electroconductive substance in a resinous coating layer, the resinous coating layer may preferably exhibit a volume resistivity of at most $10^6$ ohm.cm, more preferably at most $10^3$ ohm.cm. In case where the volume resistivity of the resinous coating layer exceeds $10^6$ ohm.cm, the toner is liable to be excessively charged, thus resulting in occurrence of blotches or inferior developing performance.

The resinous coating layer may preferably have a surface roughness Ra in the range of 0.2–3.5 $\mu$m in terms of JIS center-line-average roughness. If Ra is below 0.2 $\mu$m, the toner charge in proximity to the sleeve is liable to be excessive, so that the toner is rather firmly held by the sleeve due to an image force and accordingly a fresh toner portion cannot be charged by the sleeve, thereby lowering the developing performance. If Ra exceeds 3.5 $\mu$m, the toner coating amount on the sleeve is liable to be excessive, so that the toner cannot be sufficiently charged but is ununiformly charged, thereby causing a lowering and irregularity of image density.

The resinous coating layer 1 may comprise materials as follows.

Referring to FIG. 3, examples of the electroconductive substance 2 may include: powder of metals, such as aluminum, copper, nickel and silver; powder of metal oxides, such as antimony oxide, indium oxide and tin oxide; and carbon homologues, such as carbon fiber, carbon black and graphite powder. Among these, carbon black is particularly excellent in electroconductivity and is suitably used because it imparts an electroconductivity when incorporated in a polymeric material at a fairly arbitrarily controlled level by controlling the addition amount thereof. The carbon black may preferably have a number-average particle size of 0.001–1.0 $\mu$m, more preferably 0.01–0.8 $\mu$m. In excess of 1 $\mu$m, it becomes difficult to control the volume resistivity of the resinous coating layer.

The electroconductive substance 2 may preferably be added in 0.1–300 wt. parts, more preferably 1–100 wt. parts, per 100 wt. parts of the binder resin 4 constituting the resinous coating layer 1.

The filler 3 may comprise a negative or positive charge control agent for toners. Examples of other materials constituting the filler 3 may include: inorganic compounds, such as aluminum, asbestos, glass fiber, calcium carbonate, magnesium carbonate, barium carbonate, barium sulfate, silica and calcium silicate; phenolic resin, epoxy resin, melamine resin, silicone resin, polymethyl methacrylate, methacrylate copolymers such as styrene/n-butylmethacrylate/silane terpolymer, styrene-butadiene copolymer, polycaprolactone; nitrogen-containing compounds, such as polycaprolactam, polyvinylpyridine, and polyamide; halogen-containing polymer, such as polyvinylidene fluoride, polyvinyl chloride, polytetrafluoroethylene, polychlorotrifluoroethylene, perfluoroalkoxyltrifluoroethylene, polytetrafluoroalkoxyethylene, hexafluoropropylene-tetrafluoroethylene copolymer, and trifluorochloroethylene-vinyl chloride copolymer; polycarbonate, and polyester.

Among these, silica and alumina are preferred because of their hardness and toner chargeability controlling effect.

Such fillers 3 may preferably be used in 0.1–500 wt. part, more preferably 1–200 wt. parts, per 100 wt. parts of the binder resin 4.

The solid lubricant 5 may comprise, e.g., molybdenum disulfide, boron nitride, graphite, fluorinated graphite, silver-niobium selenide, calcium chloride-graphite, or talc. Among these, graphite may preferably be used because it has electroconductivity in addition to lubricity and may exhibit a function of reducing a portion of toner having an excessive charge to provide a level of charge suitable for development.

The solid lubricant 5 may preferably be added in 0.1–300 wt. parts, more preferably 1–150 wt. parts, per 100 wt. parts of the binder resin 4.

The binder resin 4 used for constituting the resinous-coating layer 1 optionally together with such electroconductive substance 2, filler 3 or/and solid lubricant 5, added as desired, may comprise a resin, such as phenolic resin, epoxy resin, polyamide resin, polyester resin, polycarbonate resin, polyolefin resin, silicone resin, fluorine-containing resin, styrene resin or acrylic resin. It is particularly preferred to use a thermosetting or photocurable resin.

The developing sleeve may be provided with further preferable performances by surface treatment thereof as by abrasion or polishing for surface smoothing so as to expose the electroconductive substance 2, filler 3 or/and solid lubricant 5 to the sleeve surface at an appropriate level, or/and to smooth the surface for providing a surface with a uniform unevenness. This is particularly effective for suppressing longitudinal streaks appearing in solid black or halftone images or quickly providing a sufficient image density at the startup of image formation, particularly in a high temperature/high humidity environment. The abrasion or polishing treatment may be performed by using an abrasion or polishing stripe of felt or abrasive particle-attached strip for finishing the sleeve surface to a uniform unevenness, whereby the toner coating amount on the sleeve can be uniformized, thereby allowing only toner particles subjected to triboelectrification with the sleeve to be conveyed to the developing region. This is assumed to be the mechanism for the improved performances.

After the surface-smoothing treatment, the coating layer may preferably retain a surface roughness Ra (according to JIS B0601) in the range of 0.2–3.5 $\mu$m, more preferably 0.3–2.5 $\mu$m, for the same reason as described above.

The cylindrical substrate 6 may preferably comprise a cylinder of a non-magnetic metal or a resin. For example, a non-magnetic cylindrical tube, such as that of stainless steel, aluminum or copper. Such a cylindrical tube may be produced through drawing or extrusion, preferably followed by cutting or polishing for improving the size accuracy to a prescribed size accuracy. The cylindrical tube may preferably have a straight allowance of at most 30 $\mu$m, more preferably at most 20 $\mu$m, thus providing good images. The tube may be subjected to sand blasting or abrasion for provide a rough surface with an appropriate degree of surface unevenness. The blasting may be performed by using abrasive particles which may be definitely shaped or indefinitely shaped.

Now, an embodiment of the image forming method according to the present invention, will be described with reference to FIG. 4, which illustrates an image forming apparatus including a contact charging means and a contact transfer means. In the present invention, it is possible to employ an image forming method including a corona charging scheme or/and a corona transfer scheme.

Figure 4:
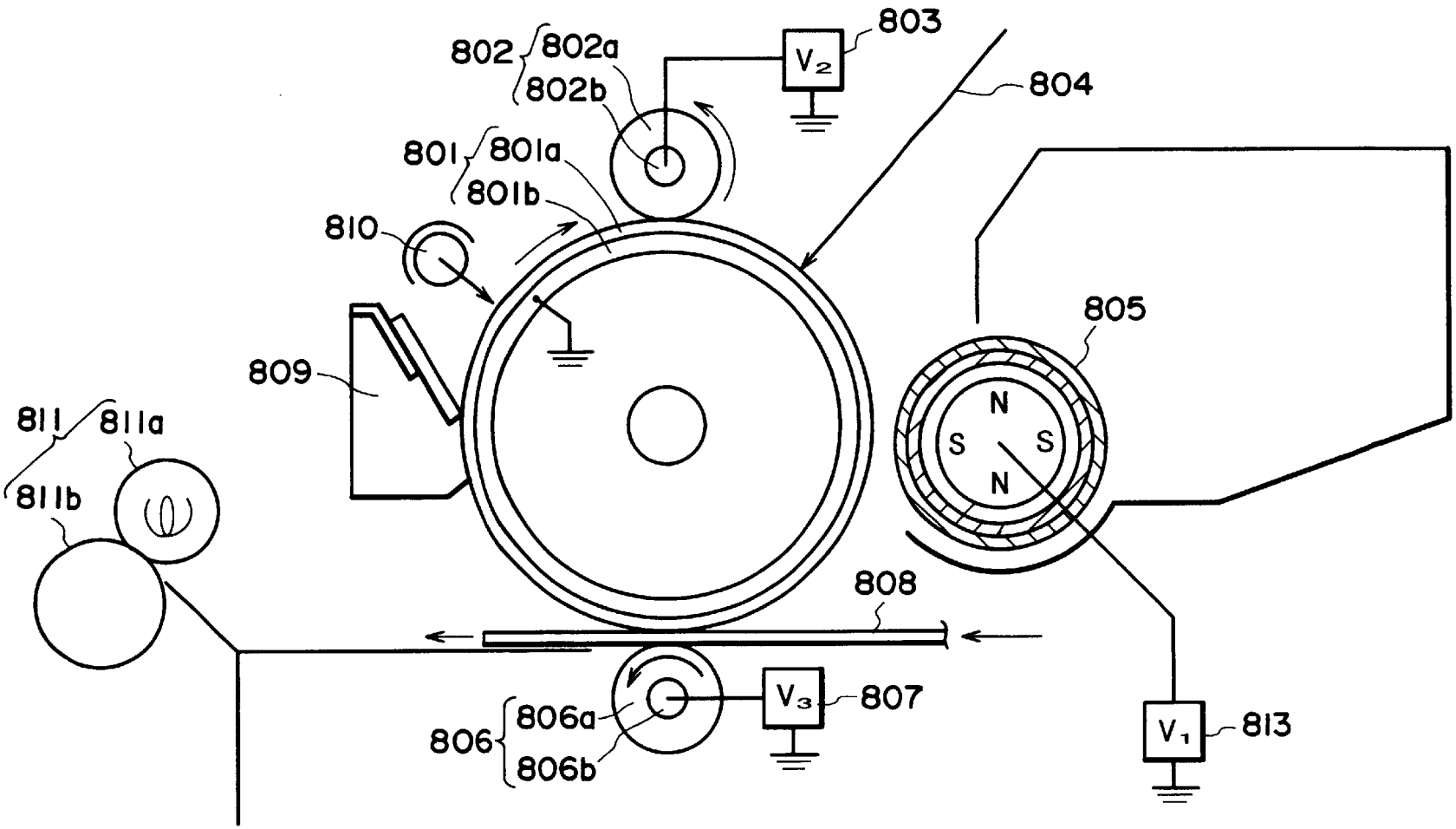
FIG. 4 is a schematic illustration of an image forming system suitable for practicing an embodiment of the image forming method according to the invention.

Referring to FIG. 4, a rotating drum-type photosensitive member 801 comprising a photoconductor layer 801*a* and an electroconductive substrate 801*b* is rotated at a prescribed peripheral speed (process speed) in a clockwise direction as shown on the drawing. A charging roller 802 comprising an electroconductive elastic layer 802*a* and a core metal 802*b* is supplied with a bias voltage V2 from a charging bias voltage supply 803. The charging roller 802 is pressed against the photosensitive member 801 and is rotated following the rotation of the photosensitive member 801.

Based on the bias voltage applied to the charging roller 802, the surface of the photosensitive member 801 is charged to a prescribed voltage of a prescribed polarity. Then, the charged photosensitive member 801 is exposed to image light 804 to form an electrostatic latent image thereon, which is then visualized as a toner image by a developing means 805. The developing means 805 includes a developing sleeve which is supplied with a bias voltage V1 from a developing bias voltage supply 813.

The toner image formed on the photosensitive member 801 is electrostatically transferred onto a transfer-receiving material 808 under the action of a transfer bias voltage V3 supplied from a voltage supply 807 via a transfer roller 806 (as a contact transfer means for pressing the transfer-receiving material 808 onto the photosensitive member 801) comprising an electroconductive elastic layer 806*a* and a core metal 806*b*. The toner image transferred onto the transfer-receiving material 808 is then fixed onto the transfer-receiving material 808 under application of heat and pressure by a heat-pressure fixing means 811 comprising a heating roller 811*a* and a pressure roller 811*b*. The surface of the photosensitive member 801 is subjected to cleaning for removal of attached soiling substance, such as transfer residual toner by a cleaning device 809 having an elastic cleaning blade abutted against the photosensitive member 801 in a counter direction, and then charge-removed by a charge-removing exposure means 810, to be used for a subsequent cycle of image formation.

While the charging roller 802 has been described as a contact charging means in the above embodiment, the primary charging means can also comprise another contact charging means, such as a charging blade or a charging brush, or alternatively a non-contact corona charging means. However, the contact charging means is less liable to cause the generation of ozone.

Further, while the transfer roller 806 has been described, the transfer means can also comprise another contact transfer means, such as a transfer blade or a transfer belt, or alternatively a non-contact corona transfer means. The contact transfer means is less liable to cause the occurrence of ozone.

Figure 5:
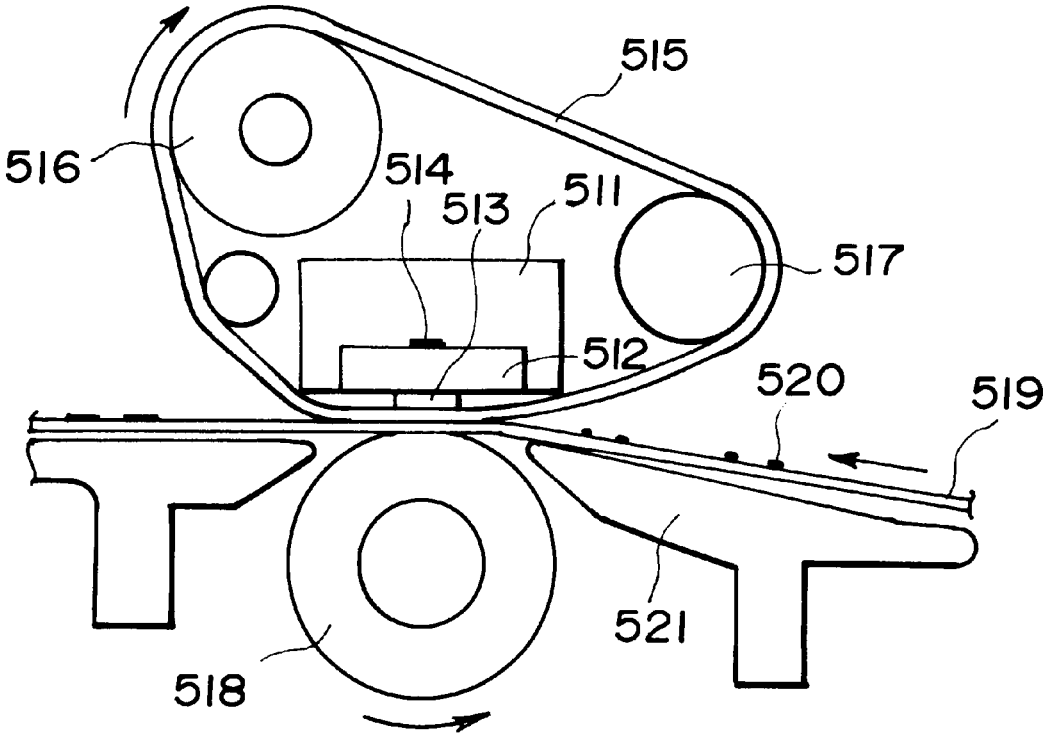
FIG. 5 is a schematic illustration of a fixing device suitable for use in an embodiment of the image forming method according to the invention.

In the image forming method according to the present invention, the heat-pressure fixing means used in a fixing step can be replaced with a film heat-fixing device as another heat-fixing means. FIG. 5 shows an example of such a film heat-fixing device, wherein a transfer material 519 carrying thereon an unfixed toner image is passed between oppositely disposed heating member 511 and pressing member 518 via a fixing film 515 under a prescribed pressure to obtain a fixed toner image.

Referring to FIG. 5, the fixing device includes the heating member 511 which has a heat capacity smaller than that of a conventional hot roller and has a linear heating part exhibiting a maximum temperature of preferably 100–300° C.

The fixing film 515 disposed between the heating member 511 and the pressing member 518 (pressing roller in this case) may preferably comprise a heat-resistant sheet having a thickness of 1–100 μm. The heat-resistant sheet may comprise a sheet of a heat-resistant polymer, such as polyester, PET (polyethylene terephthalate), PFA (tetrafluoroethylene-perfluoroalkyl vinyl ether copolymer), PTFE (polytetrafluoroethylene), polyimide, or polyamide; a sheet of a metal such as aluminum, or a laminate of a metal sheet and a polymer sheet.

The fixing film 515 may preferably have a release layer and/or a low resistivity layer on such a heat-resistant sheet.

A specific embodiment of the fixing device will be described with reference to FIG. 5.

The device includes a low-heat capacity linear heating member 511, which may for example comprise an aluminum substrate 512 of 1.0 mm-t×10 mm-W×240 mm-L, and a resistance material 513 which has been applied in a width of 1.0 mm on the aluminum substrate and is energized from both longitudinal ends. The energization is performed by applying pulses of DC 100 V and a cycle period of 20 msec while changing the pulse widths so as to control the evolved heat energy and provide a desired temperature depending on the output of a temperature sensor 514. The pulse width may range from ca. 0.5 msec to 5 msec. In contact with the heating member 511 thus controlled with respect to the energy and temperature, a fixing film 515 is moved in the direction of an indicated arrow.

The fixing film 515 may for example comprise an endless film including a 20 μm-thick heat-resistant film (of, e.g., polyimide, polyether imide, PES or PFA, provided with a coating of a fluorine-containing-resin such as PTFE or PAF on its image contact side) and a 10 μm-thick coating release layer containing an electroconductive material therein. The total thickness may generally be less than 100 μm, preferably less than 40 μm. The film is driven in the arrow direction under tension between a drive roller 516 and a mating roller 517.

The fixing device further includes a pressure roller 518 having a releasable elastomer layer of, e.g., silicone rubber and pressed against the heating member 511 via the film 515 at a total pressure of 4–20 kg, while moving together with the film 515 in contact therewith. A transfer material 519 carrying an unfixed toner image 520 is guided along an inlet guide 521 to the fixing station to obtain a fixed image by the heating described above.

The above-described embodiment includes a fixing film 515 in the form of an endless belt but the film can also be an elongated sheet driven between a sheet supply shaft and a sheet winding shaft.

Various properties and/or parameters described herein for characterizing the toner according to the present invention are based on measurement methods described below.

(1) Acid Value of Toner and Binder Resin

Measured according to JIS K-0070 under the following conditions:

Apparatus: Automatic potentiometric titration apparatus ("AT-400", available from Kyoto Denshi K.K.)

Apparatus calibration: Performed by using a mixture solvent of toluene 120 ml and ethanol 30 ml Temperature: 25° C.

Sample: Prepared by adding 1 g of a toner or a binder resin in 120 ml of toluene, followed by stirring at room temperature (ca. 25° C.) for ca. 10 hours for dissolution, and further addition of 30 ml of ethanol.

(2) Molecular Weight Distribution

The molecular weight distribution of THF (tetrahydrofuran)-soluble content in a binder resin or a toner is measured in a molecular weight region of at least 800 according to GPC (gel permeation chromatography) using THF (tetrahydrofuran) as a solvent in the following manner.

In the GPC apparatus, a column is stabilized in a heat chamber at 40° C., tetrahydrofuran (THF) solvent is caused to flow through the column at that temperature at a rate of 1 ml/min., and about 100 μl of a GPC sample solution is injected. The identification of sample molecular weight and its molecular weight distribution is performed based on a calibration curve obtained by using several monodisperse polystyrene samples and having a logarithmic scale of molecular weight versus count number. The standard polystyrene samples for preparation of a calibration curve may be those having molecular weights in the range of about $10^2$ to $10^7$ available from, e.g., Toso K.K. or Showa Denko K.K. It is appropriate to use at least 10 standard polystyrene samples. The detector may be an RI (refractive index) detector. For accurate measurement, it is appropriate to constitute the column as a combination of several commercially available polystyrene gel columns. A preferred example thereof may be a combination of Shodex GPC KF-801, 802, 803, 804, 805, 806, 807 and 800P; or a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$) and TSK guardcolumn available from Toso K.K.

Based on the thus-obtained molecular weight distribution (GPC chromatogram), an areal proportion of a component in a molecular region of $10^5$ to $10^7$ to an entire molecular weight region of at least 800 is calculated to determine the former content ($\geqq 10^5\%$).

The GPC sample may be prepared as follows.

A resinous sample is placed in THF and left standing for several hours (e.g., 5–6 hours). Then, the mixture is sufficiently shaken until a lump of the resinous sample disappears and then further left standing for more than 12 hours (e.g., 24 hours) at room temperature. In this instance, a total time of from the mixing of the sample with THF to the completion of the standing in THF is taken for at least 24 hours (e.g., 24–30 hours). Thereafter, the mixture is caused to pass through a sample treating filter having a pore size of 0.2–0.5 μm (e.g., "Maishoridisk H-25-2", available from Toso K.K.) to recover the filtrate as a GPC sample. The sample concentration is adjusted to provide a resin concentration within the range of 0.5–5 mg/ml.

(3) THF-insoluble Content

Ca. 0.5–1.0 g of a toner sample is weighed (at $W_1$ g), placed in a cylindrical filter (e.g., "No. 86R" measuring 28 mm in outer diameter and 100 mm in height, available from Toyo Roshi K.K.) and then subjected to extraction with 200 ml of solvent THF in a Soxhlet's extractor for 10 hours. During the extraction, the oil bath temperature is regulated in a range of 120–130° C. so as to cause a one-reflux cycle in 120 to 150 sec. The solvent is evaporated from the extract solution to leave a THF-soluble resin content, which is dried under vacuum at 70° C. for 10 hours and then weighed (at $W_2$ g). The weight of components, such as a magnetic material or a pigment, other than the resinous component is determined (at $W_3$ g). THF-insoluble content ($THF_{ins.}$) of the binder resin in the toner sample is calculated as follows:

$$THF_{ins.}\ (\text{wt. }\%)\ [W_1-(W_2+W_3)]/(W_1-W_3)\times 100.$$

(4) Toner DSC Curve for Determining a Wax Heat-absorption Peak Temperature ($T_{abp}$)

Measurement may be performed in the following manner by using a differential scanning calorimeter ("DSC-7", available from Perkin-Elmer Corp.) according to ASTM D3418-82.

A sample in an amount of 2–10 mg, preferably about 5 mg, is accurately weighed.

The sample is placed on an aluminum pan and subjected to measurement in a temperature range of 30–200° C. at a temperature-raising rate of 10° C./min in parallel with a blank aluminum pan as a reference.

In the course of temperature increase, a main absorption peak appears at a temperature in the range of 30–200° C. on a DSC curve. The peaktop temperature is taken as a wax heat-absorption peak temperature ($T_{abp}$) or melting point.

(5) Glass Transition Temperature (Tg) of a Binder Resin

Measurement may be performed in the following manner by using a differential scanning calorimeter ("DSC-7", available from Perkin-Elmer Corp.) according to ASTM D3418-82.

A sample in an amount of 5–20 mg, preferably about 10 mg, is accurately weighed.

The sample is placed on an aluminum pan and subjected to measurement in a temperature range of 30–200° C. at a temperature-raising rate of 10° C./min in parallel with a blank aluminum pan as a reference to obtain a DSC curve.

In the course of temperature increase, a main absorption peak appears in the temperature region of 40–100° C.

In this instance, the glass transition temperature (Tg) is determined as a temperature at an intersection between a DSC curve and an intermediate line drawn so as to divide a distance between the parallel base lines obtained before and after the appearance of the absorption peak into exactly equal halves.

(6) Molecular Weight Distribution of a Wax

The molecular weight (distribution) of a wax may be measured by GPC under the following conditions:

Apparatus: "GPC-150C" (available from Waters Co.)

Column: "GMH-HT" 30 cm-binary (available from Toso K.K.)

Temperature: 135° C.

Solvent: o-dichlorobenzene containing 0.1% of ionol.

Flow rate: 1.0 ml/min.

Sample: 0.4 ml of a 0.15%-sample.

Based on the above GPC measurement, the molecular weight distribution of a sample is obtained once based on a calibration curve prepared by monodisperse polystyrene standard samples, and re-calculated into a distribution corresponding to that of polyethylene using a conversion formula based on the Mark-Houwink viscosity formula.

(7) Contact Angle of a Toner

Measured by using a contact angle meter ("FACE Contact Angle Meter", made by Kyowa Kaimen Kagaku K.K.). For measurement, ca. 10 g of a toner is compressed for 2 min. under a pressure of 200 kgf/cm$^2$ into a sample in the form of a disk-shaped tablet (diameter=25 mm, thickness=ca. 10 mm). The toner tablet is placed in a glass sample bottle (inner diameter=ca. 27 mm) (e.g., "SNAP CUP No. 30") and placed on a hot plate heated at 100–120° C. via a Teflon sheet, followed by application of a pressure of 5–10 kgf/cm$^2$ for ca. 5–10 min. After the toner is softened or melted, the glass sample bottle containing the toner is cooled and broken to take out the toner therefrom. The resultant melt-formed toner is successively polished with abrasive papers (#280, #800 and #1500) to prepare a cylindrical tablet sample (diameter=25 mm, thickness=5 mm) having a measurement surface free from scars or flaws by eye observation.

Measurement of a contact angle is performed five times for each sample by using the above measurement apparatus in combination with deionized water or commercially-available purified water.

Based on the thus-measured five values, an average thereof is taken as a contact angle to water of the sample toner.

(8) Particle Size Distribution of a Toner

A particle size distribution of a toner may be measured according to the Coulter counter method, e.g., by using Coulter Counter TA-II or Coulter Multisizer (available from Beckman Coulter Co.) together with an electrolytic solution comprising a ca. 1% NaCl aqueous solution which may be prepared by dissolving a reagent-grade sodium chloride or commercially available as "ISOTON-II" (from Beckman Coulter Co.). For measurement, into 100 to 150 ml of the electrolytic solution, 0.1 to 5 ml of a surfactant (preferably an alkyl benzenesulfonic acid salt) is added as a dispersant, and 2–20 mg of a sample is added. The resultant dispersion of the sample in the electrolytic solution is subjected to a dispersion treatment by an ultrasonic disperser for ca. 1–3 min., and then subjected to measurement of particle size distribution by using the above-mentioned apparatus equipped with a 100 μm-aperture. The volume and number of toner particles having particle sizes of 2.00 μm or larger are measured for respective channels to calculate a volume-basis distribution and a number-basis distribution of the toner. From the volume-basis distribution, a weight-average particle size ($D_4$) of the toner is calculated by using a central value as a representative for each channel.

The channels used include 13 channels of 2.00–2.52 μm; 2.52–3.17 μm; 3.17–4.00 μm; 4.00–5.04 μm; 5.04–6.35 μm; 6.35–8.00 μm; 8.00–10.08 μm, 10.08–12.70 μm; 12.70–16.00 μm; 16.00–20.20 μm; 20.20–25.40 μm; 25.40–32.00 μm: and 32.00–40.30 μm.

(9) Sulfur Content in a Toner

Sulfur content in a toner sample may be measured by fluorescent X-ray analysis (according to JIS-K0119 "Fluorescent X-ray Analysis General Rules") by using a fluorescent X-ray analyzer (e.g., "SYSTEM 3080", made by Rigaku Denki Kogyo K.K.).

(10) Non-iron Element Content in Magnetic Iron Oxide

Measured by fluorescent X-ray analysis (according to JIS-K0119 "Fluorescent X-ray Analysis General Rules") by using a fluorescent X-ray analyzer (e.g., "SYSTEM 3080", made by Rigaku Denki Kogyo K.K.).

(11) Non-iron Element Distribution in Magnetic Iron Oxide

Distribution of each non-iron element in sample magnetic iron oxide is measured by gradually dissolving the magnetic iron oxide with hydrochloric acid or hydrofluoric acid and successively measuring the concentration of the non-iron element in the solution at respective dissolution stages relative to the concentration of the fully dissolved solution, respectively by ICP (inductively coupled plasma) emission spectrometry.

(12) Number-average Particle Size (D1) of a Magnetic Material

Measured as a number-average of diameters of 300 particles selected at random on photographs at a magnification of $4\times10^4$ taken through a transmission electron microscope and processed by a digitizer.

(13) Magnetic Properties of a Magnetic Material

Measured by using a sample oscillation-type magnetometer ("VSM-3S-15", made by Toei Kogyo K.K.).

(14) BET Specific Surface Areas ($S_{BET}$) of a Magnetic Material and a Fine Powdery External Additive.

Measured according to a BET multi-point method using nitrogen as the adsorbate gas and a specific surface area meter ("AUTOSORB 1", made by Tuasa Ionics K.K.).

(15) Dielectric Loss Tangent (tanδ) of a Toner

Calculated from a complex dielectric constant measured at a frequency of 100 kHz by using a holder (electrodes) for dielectric measurement ("4284A Precision LCR Meter", made by Hewlett-Packard Corp.) after calibration at frequencies of 1 kHz and 1 kHz.

For measurement, 0.7 g of a magnetic toner (or 0.4 g of a non-magnetic toner) is weighed and molded into a disk-shaped sample of 25 mm in diameter and at most 1 mm (preferably 0.5–0.9 mm) in thickness by applying a pressure of 39200 kPa (400 kg-f/cm$^2$) for 2 min. The sample is set in a viscoelasticity-measurement apparatus ("ARES", made by Rheometrics Scientific F.E.) of which the 25 mm-dia. holder has been replaced with the dielectric measurement holder (electrodes) ("LCR Meter"), and melt-set by heating up to 130° C., followed by cooling down to 25° C. The measurement is performed at a frequency of 100 kHz while constantly applying a load of 0.49 N (50 g) to the sample and heating at a rate of 2° C./min. up to 150° C. The measurement is performed at 15 sec. intervals.

(16) Methanol Wettability ($W_{MeOH}$) of Inorganic Fine Powder

The methanol wettability of inorganic fine powder externally added to a toner can be measured by using a powder wettability tester ("WET-100P", made by Rhesca Co.). For the measurement, 50 ml of pure water (deionized water or commercially available purified water) is placed in a 100 ml-beaker, and 0.2 g of an inorganic fine powder sample is accurately weighed therein. Into the system under stirring, methanol is added dropwise thereto at a rate of 3 ml/min. If the inorganic fine powder begins to sink and be dispersed in the aqueous solution, the transmittance through the solution is lowered, and the amount of added methanol (ml) up to that time is measured to calculate a volumetric percentage of the added methanol in the methanol/water mixture as a methanol wettability (%).

(17) Toner Particle Circularity (Ci)

The circularity values described herein are based on values measured by using a flow-type particle image analyzer ("FPIA-1000", available from Toa Iyou Denshi K.K.). The details of the measurement is described in a technical brochure and an attached operation manual on "FPIA-1000" published from Toa Iyou Denshi K.K. (Jun. 25, 1995) and JP-A 8-136439 (U.S. Pat. No. 5,721,433). The outline of the measurement is as follows.

For an actual measurement of circularity by using the FPIA-measurement, 0.1–0.5 ml of a surfactant (preferably an alkylbenzenesulfonic acid salt) as a dispersion aid is added to 100 to 150 ml of water from which impurities have been removed, and ca. 0.1–0.5 g of sample particles are added thereto. The resultant mixture is subjected to dispersion with ultrasonic waves (50 kHz, 120 W) for 1–3 min. to obtain a dispersion liquid containing 12,000–20,000 particles/μl and the dispersion liquid is subjected to measurement of a circularity distribution with respect to particles having a circle-equivalent diameter ($D_{CE}=L_0/\pi$) in the range of 0.60 μm to below 159.21 μm by means of the above-mentioned flow-type particle image analyzer.

EXAMPLES

Hereinbelow, the present invention will be described more specifically based on Examples, which however should not be construed to restrict the scope of the present invention in any way.

Production of Sulfur-Containing Polymers

Production Example 1

In a pressurizable reaction vessel equipped with a reflux pipe, a stirrer, a thermometer, a nitrogen-intake pipe, a dropwise addition device and a reduced pressure-generating means, solvents including 250 wt. parts of methanol, 150 wt. parts of 2-butanone and 100 wt. parts of 2-propanol, and monomers including 65 wt. parts of styrene, 28 wt. parts of n-butyl acrylate and 7 wt. parts of 2-acrylamido-2-methylpropanesulfonic acid were placed and heated to reflux temperature under stirring. Then, a solution of 3 wt. parts of 2,2'-azobis(2-methylbutyronitrile) (polymerization initiator) in 20 wt. parts of 2-butanone was added dropwise to the system in 1 hour, followed by continuation for 5 hours of stirring. Further, a solution of 1 wt. part of 2,2-azobis(2-methylbutyronitrile) in 20 wt. parts of 2-butanone was added dropwise to the system in 30 min., followed by further 5 hours of stirring to complete the polymerization. After distilling off the polymerization solvent under a reduced pressure, the resultant polymer was coarsely crushed to below 100 μm by means of a cutter mill equipped with a 150-mesh screen, to obtain Sulfur-containing polymer (S-1), which exhibited a glass transition temperature (Tg) of 74° C., a weight-average molecular weight (Mw) of 28000, and an acid value (Av) of 29 mgKOH/g.

Production Example 2

Sulfur-containing polymer (S-2) was prepared in the same manner as in Production Example 1 except that the monomers were changed to 93 wt. parts of styrene, 7 wt. parts of 2-acrylamido-2-methylpropane-sulfonic acid and 0.1 wt. part of divinylbenzene, and the polymerization initiator solution was added in 90 min.

Sulfur-containing polymer (S-2) exhibited Tg=103° C., Mw=184000 and Av=21 mgKOH/g.

Production Example 3

Sulfur-containing polymer (S-3) was prepared in the same manner as in Production Example 1 except that the monomers were changed to 53 wt. parts of styrene, 40 wt. parts of n-butylacrylate and 7 wt. parts of 2-acrylamido-2-methylpropane-sulfonic acid and the polymerization was performed at the reflux temperature.

Sulfur-containing polymer (S-3) exhibited Tg=36° C., Mw=4300 and Av=27 mgKOH/g.

Production Example 4

Sulfur-containing polymer (S-4) was prepared in the same manner as in Production Example 1 except that the polymerization solvent was changed to 900 wt. parts of toluene, the monomers were changed to 71 wt. parts of styrene, 26 wt. parts of n-butyl acrylate and 3 wt. parts of 2-acrylamido-2-methylpropane-sulfonic acid, the polymerization initiator was changed to 2 wt. parts of 2,2'-azobis(2,4-dimethylvaleronitrile, and the polymerization was effected for 8 hours at 90° C.

Sulfur-containing polymer (S-4) exhibited Tg=39° C., Mw=20000 and Av=9 mgKOH/g.

Production Example 5

Sulfur-containing polymer (S-5) was prepared in the same manner as in Production Example 1 except that the polymerization solvents were changed to 300 wt. parts of methanol and 100 wt. parts of toluene, the monomers were changed to 570 wt. parts of styrene and 30 wt. parts of 2-acrylamido-2-methylpropane-sulfonic acid, the polymerization initiator was changed to 12 wt. parts of lauroyl peroxide, and the polymerization was effected at 65° C. for 10 hours.

Sulfur-containing polymer (S-5) exhibited Tg=69° C., Mw=3500 and Av=17 mgKOH/g.

Production Example 6

Sulfur-containing polymer (S-6) was prepared in the same manner as in Production Example 1 except that the polymerization solvents were changed to 50 wt. parts of methanol and 1000 wt. parts of xylene, the monomers were changed to 700 wt. parts of styrene, 200 wt. parts of n-butyl methacrylate and 100 wt. parts of 2-acrylamido-2-methylpropanesulfonic acid, the polymerization initiator was changed to 60 wt. parts of 2,2'-azobis(2,4-dimethylvaleronitrile) and the polymerization was effected at 80° C. for 5 hours.

Sulfur-containing polymer (S-6) exhibited Tg=79° C., Mw=10500 and Av=29 mgKOH/g.

Production Example 7

A first-step polymerization was performed in a similar manner as in Production Example 1 by using 200 wt. parts of xylene as the solvent, 35 wt. parts of styrene and 10 wt. parts of butyl acrylate as the monomers and 3 wt. parts of 1,1-bis(t-butylperoxy)-2-methylcyclohexane as the polymerization initiator and holding the system for 8 hours at the reflux temperature. Then, as a second-step polymerization, the reaction vessel was heated to 120° C., and a monomer composition comprising 30 wt. parts of styrene, 18 wt. parts of butyl acrylate, 7 wt. parts of 2-acrylamido-2-methylpropanesulfonic acid and 50 wt. parts of xylene was added dropwise in 1 hour to keep the system at that temperature for 5 hours, thereby completing the polymerization. The xylene was distilled off under a reduced pressure to obtain Sulfur-containing polymer (S-7).

Sulfur-containing polymer (S-7) exhibited Tg=72° C., Mw=27000, and Av=30.3 mgKOH/g.

Production Example 8

Bulk polymerization of monomers comprising 70 wt. parts of styrene, 27 wt. parts of n-butyl acrylate and 3 wt. parts of 2-acrylamido-2-methylpropane-sulfonic acid was effected at 120° C. for 8 hours without using polymerization solvent or polymerization initiator otherwise under similar conditions as in Production Example 1. Then, 50 wt. parts of xylene was added, and the system was cooled to 110° C. Further, a solution of 1 wt. part of t-butyl peroxy-2-ethylhexanoate in 50 wt. parts of xylene was added dropwise in 6 hours, followed by further 1 hour of stirring to recover Sulfur-containing polymer (S-8), otherwise in a similar manner as in Production Example 1.

Sulfur-containing polymer (S-8) exhibited Tg=58° C., Mw=270000, and Av=8 mgKOH/g.

Production Example 9

Sulfur-containing polymer (S-9) was prepared in the same manner as in Production Example 1 except that the monomers were changed to 93 wt. parts of 4-t-butylstyrene and 7 wt. parts of 2-acrylamido-2-methylpropane-sulfonic acid.

Sulfur-containing polymer (S-9) exhibited Tg=133° C., Mw=14000 and Av=22 mgKOH/g.

Production Example 10

Sulfur-containing polymer (S-10) was prepared in the same manner as in Production Example 1 except that the polymerization solvents were changed to 300 wt. parts of methanol and 100 wt. parts of toluene, the monomers were changed to 540 wt. parts of styrene and 60 wt. parts of 2-acrylamido-2-methylpropane-sulfonic acid, the polymerization initiator was changed to 60 wt. parts of lauroyl peroxide, and the polymerization was effected for 10 hours at the reflux temperature.

Sulfur-containing polymer (S-10) exhibited Tg=27° C., Mw=1700 and Av=35 mgKOH/g.

Production of Toner Binder Resins

Low-Molecular Weight Polyester Resins

Production Example 1

| | |
|---|---|
| Fumaric acid | 42 mol. % |
| Trimellitic anhydride | 20 mol. % |
| Bisphenol derivative of the formula (4) (R = ethylene, x + y = 2.4) | 12 mol. % |
| Bisphenol derivative of the formula (4) (R = propylene, x + y = 2.2) | 26 mol. % |

The above ingredients were placed in a reaction vessel equipped with a cooling pipe, a stirrer, a thermometer, a nitrogen-intake pipe and a reduced pressure-generating means, and after adding dibutyltin oxide (as an esterification catalyst), the system was heated to 160° C. in a nitrogen atmosphere. Then, the pressure was reduced to ca. 15 hPa, and the temperature was raised to 200° C., followed by maintenance of the temperature and pressure for 3 hours to complete the esterification to obtain Polyester resin (PL-1) of low-molecular weight-type, which contained substantially no THF-insoluble matter and exhibited an acid value (Av) of 26 mgKOH/g.

Production Example 2

| | |
|---|---|
| Terephthalic acid | 26 mol. % |
| Dodecenylsuccinic anhydride | 24 mol. % |
| Trimellitic anhydride | 19 mol. % |
| Bisphenol derivative of formula (4) (R = ethylene, x + y = 2.4) | 13 mol. % |
| Bisphenol derivative of formula (4) (R = ethylene, x + y = 2.2) | 18 mol. % |

Polyester resin (PL-2) (of the low molecular weight-type containing substantially no THF-insoluble matter and exhibiting Av=44 mgKOH/g was prepared by using the above ingredients otherwise in the same manner as in Production Example 1.

High-Molecular Weight Polyester Resins

Production Example 3

| | |
|---|---|
| Fumaric acid | 17 mol. % |
| Trimellitic anhydride | 39 mol. % |
| Bisphenol derivative of the formula (4) (R = ethylene, x + y = 2.4) | 21 mol. % |
| Bisphenol derivative of the formula (4) (R = propylene, x + y = 2.2) | 23 mol. % |

The above ingredients were placed in a reaction vessel equipped with a cooling pipe, a stirrer, a thermometer, a nitrogen-intake pipe and a reduced pressure-generating means, and after adding dibutyltin oxide (as an esterification catalyst), the system was heated to 160° C. in a nitrogen environment. Then, the pressure was reduced to ca. 15 hPa, and the temperature was raised to 200° C., followed by maintenance of the temperature and pressure for 9 hours to complete the esterification to obtain Polyester resin (PH-1) of high-molecular weight-type, which contained ca. 27 wt. % THF-insoluble matter and exhibited an acid value (Av) of ca. 25 mgKOH/g.

Production Example 4

| | |
|---|---|
| Terephthalic acid | 26 mol. % |
| Dodecenylsuccinic anhydride | 24 mol. % |
| Trimellitic anhydride | 19 mol. % |
| Bisphenol derivative of formula (4) (R = ethylene, x + y = 2.4) | 13 mol. % |
| Bisphenol derivative of formula (4) (R = ethylene, x + y = 2.2) | 18 mol. % |

Polyester resin (PH-2) (of the high molecular weight-type) containing ca. 29 wt. % THF-insoluble matter and exhibiting Av=ca. 14 mgKOH/g was prepared by using the above ingredients otherwise in the same manner as in Production Example 3.

Low-Molecular Weight Vinyl Polymers

Production Example 5

200 wt. parts of xylene was placed in a reaction vessel equipped with a reflux pipe, a stirrer, a thermometer, a nitrogen-intake pipe, a dropwise addition device, and a reduced pressure-generating means, and heated to reflux temperature in a nitrogen atmosphere. Then, a monomer mixture comprising 77 wt. parts of styrene, 20 wt. parts of butyl acrylate and 3 wt. parts of monobutyl maleate, and a solution of 3.2 wt. parts of di-t-butyl peroxide (polymerization initiator) in 10 wt. parts of xylene, were added dropwise in 1 hour, followed by further 4 hours of refluxing and distilling-off of xylene under a reduced pressure to obtain Vinyl polymer (VL-1) of low-molecular weight type.

Vinyl polymer (VL-1) exhibited Tg=61° C., Mw=11000 and Av=9 mgKOH/g.

Production Example 6

Vinyl polymer (VL-2) was prepared in the same manner as in Production Example 5 except for changing the monomers to 74 wt. parts of styrene, 21 wt. parts of butyl acrylate and 6 wt. parts of monobutyl maleate, and changing the amount of the di-t-butyl peroxide (polymerization initiator) to 4 wt. parts.

Vinyl polymer (VL-2) exhibited Tg=60° C., Mw=6400 and Av=17 mgKOH/g.

High-Molecular Weight Vinyl Polymers

A monomer composition comprising 70 wt. parts of styrene, 3 wt. parts of butyl acrylate, 2 wt. parts of monobutyl maleate and 0.25 wt. part of t-amyl peroxy-2-ethylhexanoate (polymerization initiator), was added to and suspended in 200 wt. parts of degassed deionized water containing 2 wt. parts of polyvinyl alcohol in a reaction vessel equipped with a reflux pipe, a stirrer, a thermometer and a nitrogen-intake pipe. The system was heated to 70° C. while being aerated with nitrogen and held at that temperature for 20 hours. Then, 0.5 wt. part of benzoyl peroxide was added to the system, which was held for further 4 hours and heated to and retained at 95° C. for 2 hours to complete the polymerization.

The polymerizate in the suspension liquid after the reaction was filtered out, washed with water and dried to obtain Vinyl polymer (VH-1) of high-molecular weight type, which exhibited Tg=59° C., Mw=796000 and Av=7 mgKOH/g and contained substantially no THF-insoluble matter.

Production Example 9

Vinyl polymer (VH-2) was prepared in the same manner as in Production Example 8 except for changing the monomer composition to one comprising 69.5 wt. parts of styrene, 28.5 wt. parts of butyl acrylate, 2 wt. parts of monobutyl maleate and 0.2 wt. parts of 2,2'-bis(4,4-di-t-butylperoxycyclohexyl)propane (polymerization initiator), and changing the polymerization temperature to 75° C.

Vinyl polymer (VH-2) exhibited Tg=57° C., Mw=1403000, Av=6 mgKOH/g and THF-insoluble content ($THF_{ins.}$) of 4.5 wt. %.

Production Example 10

Vinyl polymer (VH-3) was prepared in the same manner as in Production Example 9 except for changing the monomer composition to one comprising 75 wt. parts of styrene, 20.5 wt. parts of butyl acrylate, 4 wt. parts of monobutyl maleate, 0.5 wt. part of divinylbenzene and 0.2 wt. parts of 2,2'-bis(4,4-di-t-butylperoxycyclohexyl)propane (polymerization initiator).

Vinyl polymer (VH-3) exhibited Tg=62° C., Mw=370000 and Av=12 mgKOH/g.

Production of Binder Resins Comprising Vinyl Polymers

Production Example 11

In a mixing vessel equipped with a reflux pipe, a stirrer, a thermometer and a reduced pressure-generating means, 200 wt. parts of xylene was placed, and 75 wt. parts of Vinyl polymer (VL-1), 25 wt. parts of Vinyl polymer (VH-1) and 5 wt. parts of Wax (3) shown in Table 2 appearing hereinafter were added thereto. The system was heated to reflux temperature under stirring and further stirred for 2 hours under the condition. Then, the xylene was distilled off under a reduced pressure to obtain Binder resin (B-1).

Production Example 12

Binder resin (B-2) was prepared by changing the polymer components to 75 wt. parts of Vinyl polymer (VL-2) and 25 wt. parts of Vinyl polymer (VH-2) otherwise in the same manner as in Production Example 11.

Production Example 13

Binder resin (B-3) was prepared by changing the polymer components to 75 wt. parts of Vinyl polymer (VL-3) and 25 wt. parts of Vinyl polymer (VH-3) otherwise in the same manner as in Production Example 11.

Production Example 14

Binder resin (B-4) was prepared by changing the 3 wt. parts of Wax (3) to 3 wt. parts of Wax (1) and 3 wt. parts of wax (3) shown in Table 2 otherwise in the same manner as in Production Example 11.

Production Example 15

Binder resin (B-5) was prepared by changing the 3 wt. parts of Wax (3) to 3 wt. parts of Wax (1) and 3 wt. parts of Wax (5) shown in Table 2 otherwise in the same manner as in Production Example 11.

Production and Evaluation of Toners

Example 1

Toner Production

| | |
|---|---|
| Polyester resin (PL-1) (low-molecular weight-type) | 30 wt. part(s) |
| Polyester resin (PH-1) (high-molecular weight-type) | 70 wt. part(s) |
| Magnetic iron oxide (D1 = 0.22 μm, coercive force = 9.6 kA/m, saturation magnetization = 83 $Am^2/kg$, residual magnetization = 15 $Am^2/kg$) | 90 wt. part(s) |
| Sulfur-containing polymer (S-1) | 2 wt. part(s) |
| Charge control agent (organo-aluminum compound comprising 2 mols of 3,5-di-t-butylsalicylic acid and 1 mol of aluminum) | 1 wt. part(s) |

The above ingredients were melt-kneaded by means of a twin-screw kneading extruder heated at 130° C. After being cooled, the melt-kneaded product was coarsely crushed by a cutter mill and pulverized by a jet mill at a good pulverizability to provide a pulverizate showing a weight-average particle size (D4) of 7.4 μm, and a volume-percentage of particles of 10.1 μm or larger (V % (≧10.1 μm)) of 6.8%. The pulverizate was further classified by a pneumatic classifier to obtain toner particles.

Then, 100 wt. parts of the toner particles were blended with 1 wt. part of hydrophobized dry-process silica (showing a methanol wettability ($W_{MeOH}$) of 76% and a BET specific surface area ($S_{BET}$) of 200 $m^2/g$) by a Henschel mixer to obtain Magnetic toner (1).

Magnetic toner (1) exhibited D4=7.6 μm, a number-basis percentage of particles having a circularity Ci≧0.950 (N % (Ci≧0.950)) of 67% and a volume-basis percentage of particles of 10.1 μm or layer (V % (≧10.1 μm)) of 6.1%.

As shown in Table 3 appearing hereinafter, Magnetic toner (1) exhibited a THF-insoluble content ($THF_{ins}$) of 27 wt. % based on the binder resin, a molecular weight distribution of the THF-soluble matter including a peak molecular weight of $10^5$ to $10^7$ (content (≧$10^5$)) of 3% and dielectric loss tangents (tanδ at 100 kHz) giving a maximum of $4.5\times10^{-2}$ at 107°. Further, the toner particles contained a sulfur content (S-content) of ca. 100 ppm attributable to Sulfur-containing polymer (S-1) and an acid value (Av) of 14 mgKOH/g.

The toner properties are inclusively shown in Table 3 (or 3A) together with those of toners obtained in Example and Comparative Examples described hereinafter.

Performance Valuation

Magnetic toner (1) was incorporated in a digital copying machine ("GP-215", made by Canon K.K.; process speed= 145 mm/sec, film fixing-type) and a copying machine ("NP-6650", made by Canon K.K.; process speed=320 mm/sec, hot-roller fixing-type), respectively, after remodeling of removing the toner cleaning member from each fixing device to evaluate image forming performances in a continuous image formation on 20000 sheets for "GP-215" or 50000 sheets for "NP-6650", in a normal temperature/normal humidity environment (NT/NH=25° C./60%RH), and thereafter soiling on attached toner on the fixing device members (heating film, hot roller and pressure roller) was evaluated by eye observation:

Separately, the fixing devices of the copying machines ("GP-215" and "NP-6650") were taken out of the machines and each provided with an external driver and a temperature controller and were subjected to a fixing performance test wherein yet-unfixed toner images each of 20 mm×20 mm formed on paper so as to provide an image density of 1.0 were subjected to fixing at varying fixing temperatures and at a prescribed fixing speed (for each copying machine) to evaluate fixing performances inclusive of low-temperature fixability (fixability) and anti-hot-offset characteristic (Offset).

Further, a developing performance evaluation was performed under similar image forming conditions by using "GP-215" and "NP-6650", respectively, but in a high temperature/high humidity environment (HT/HH=30° C./80%RH). More specifically, the developing performance was evaluated by measuring an image density on a 10th sheet as an evaluation at an initial stage in a continuous image formation on 2000 sheets and then each machine was left to stand for 24 hours in the environment. Thereafter the continuous image formation was re-started, and the image densities on a 10th sheet was again measured.

The results are inclusively shown in Table 4 (or 4A) together with those of Examples and Comparative Examples described hereinafter.

Examples 2–4

Toners (2)–(4) were prepared and evaluated in the same manner as in Example 1 except that different particle size levels of toner particles were prepared by using different pulverization conditions.

Examples 5–16

Toners (5)–(16) were prepared evaluated in the same manner as in Example 1 except for using Sulfur-containing polymers shown in Table 3 in the indicated amounts. As a result, the pulverizability of the kneaded product was somewhat inferior than in Example 1.

Example 17

Toner (17) was prepared and evaluated in the same manner as in Example 1 except for omitting the charge control agent (organo-aluminum compound comprising 2 mols of 3,5-di-t-butylsalicylic acid and 1 mol of aluminum), whereby the pulverizability of the kneaded product was somewhat inferior than in Example 1 to provide a pulverizate showing D4=7.4 μm and containing 4.7% by volume of particles of 12.7μ or larger.

Example 18

Toner (18) was prepared and evaluated in the same manner as in Example 1 except for changing the binder resins to 30 wt. parts of Polyester resin (PL-1) and 70 wt. parts of Polyester resin (PH-2).

Example 19

Toner (19) was prepared and evaluated in the same manner as in Example 1 except for changing the binder resins to 70 wt. parts of Polyester resin (PL-2) and 30 wt. parts of Polyester resin (PH-1).

Example 20

Toner (20) was prepared and evaluated in the same manner as in Example 1 except for changing the binder resins to 105 wt. parts of Binder resin (B-1) (vinyl resin-type).

Example 21

Toner (21) was prepared and evaluated in the same manner as in Example 1 except for changing the binder resins to 105 wt. parts of Binder resin (B-2) (vinyl resin-type).

Example 22

Toner (22) was prepared and evaluated in the same manner as in Example 1 except for changing the binder resins to 105 wt. parts of Binder resin (B-3) (vinyl resin type).

Example 23

Toner (23) was prepared and evaluated in the same manner as in Example 1 except for changing the binder resins to 107 wt. parts of Binder resin (B-4) (vinyl resin type).

Example 24

Toner (24) was prepared and evaluated in the same manner as in Example 1 except for changing the binder resins to 107 wt. parts of Binder resin (B-5) (vinyl resin type).

Examples 25–30

Toners (25)–(30) were prepared and evaluated in the same manner as in Example 1 except for using Sulfur-containing polymers shown in Table 3A in the indicated amounts.

Comparative Examples 1–3

Comparative Toners (1)–(3) were prepared and evaluated in the same manner as in Example 1 except for using Sulfur-containing polymers (S-8)-(S-10), respectively.

Comparative Example 4

Comparative Toner (4) was prepared and evaluated in the same manner as in Example 1 except for omitting Sulfur-containing polymer (S-1).

Comparative Examples 5–7

Comparative Toners (5)–(7) were prepared and evaluated in the same manner as in Example 20 except for using Sulfur-containing polymers (S-8)-(S-10), respectively.

Comparative Example 8

Comparative toner (8) was prepared and evaluated in the same manner as in Example 20 except for omitting Sulfur-containing polymer (S-1).

TABLE 2

Waxes

| Name | Type | Molecular weights Mp | Molecular weights Mw/Mn | DSC curve $T_{abp}$*1 | DSC curve $T_{ab\cdot sp}$*2 |
|---|---|---|---|---|---|
| Wax(1) | paraffin wax | 510 | 1.3 | 81° C. | ND*3 |
| Wax(2) | maleic acid-modified polypropylene | 2700 | 6.9 | 123° C. | ND |
| Wax(3) | hydrocarbon wax | 960 | 1.6 | 106° C. | ND |
| Wax(4) | wax of formula(1) (A = OH) | 800 | 1.8 | 109° C. | ND |
| Wax(5) | ethylene/propylene (5/95 wt.) copolymer | 3200 | 11.0 | 139° C. | ND |
| Mix-1 | Wax(1)/Wax(3) = 1/1 | 510 | 1.5 | 81° C. | 105° C. |
| Mix-2 | Wax(1)/Wax(5) = 1/1 | 510 | 9.6 | 82° C. | 138° C. |

*1 $T_{abp}$ = heat-absorption peak temperature
*2 $T_{ab\cdot sp}$ = heat-absorption sub-peak temperature
*3 ND = not detected

TABLE 3

Toners

| Example | Sulfur-containg polymer (wt. parts) | tan δ at 100 kHz Max | tan δ at 100 kHz Temp | Contact angle | D4 (μm) | V % (≧10.1 μm) | N % (Ci ≧ 0.950) | S-content (ppm) | Acid value (mgKOH/g) | THF ins (wt %) | Molecular weight Mp | Molecular weight content ≧$10^5$ (%) |
|---|---|---|---|---|---|---|---|---|---|---|---|---|
| 1 | S-1 (2) | $4.5 \times 10^{-2}$ | 107° C. | 126° | 7.6 μm | 6.1% | 67% | ca. 100 | 14 | 27 | 7100 | 3% |
| 2 | S-1 (2) | $4.3 \times 10^{-2}$ | 105° C. | 125° | 6.4 μm | 1.9% | 76% | ca. 100 | 14 | 27 | 7100 | 3% |
| 3 | S-1 (2) | $3.2 \times 10^{-2}$ | 103° C. | 123° | 8.8 μm | 8.4% | 61% | ca. 100 | 14 | 27 | 7100 | 3% |
| 4 | S-1 (2) | $3.0 \times 10^{-2}$ | 103° C. | 119° | 10.9 μm | 49% | 57% | ca. 100 | 14 | 27 | 7100 | 3% |
| 5 | S-1 (0.1) | $3.0 \times 10^{-2}$ | 103° C. | 120° | 7.5 μm | 8.4% | 58% | ca. 10 | 14 | 31 | 7000 | 2% |
| 6 | S-1 (7) | $4.5 \times 10^{-2}$ | 108° C. | 116° | 7.7 μm | 6.7% | 67% | ca. 700 | 15 | 24 | 7200 | 4% |
| 7 | S-2 (2) | $3.8 \times 10^{-2}$ | 103° C. | 121° | 7.5 μm | 6.3% | 68% | ca. 70 | 14 | 29 | 7000 | 3% |
| 8 | S-3 (2) | $5.6 \times 10^{-2}$ | 103° C. | 109° | 7.7 μm | 6.0% | 70% | ca. 80 | 14 | 25 | 7200 | 4% |
| 9 | S-4 (2) | $3.1 \times 10^{-2}$ | 103° C. | 116° | 7.4 μm | 7.3% | 60% | ca. 30 | 14 | 25 | 7000 | 4% |
| 10 | S-4 (0.1) | $2.9 \times 10^{-2}$ | 103° C. | 118° | 7.4 μm | 9.5% | 55% | <10 | 14 | 28 | 6800 | 1% |
| 11 | S-4 (7) | $3.1 \times 10^{-2}$ | 103° C. | 115° | 7.4 μm | 7.0% | 65% | ca. 180 | 15 | 21 | 7200 | 5% |
| 12 | S-5 (2) | $3.3 \times 10^{-2}$ | 103° C. | 117° | 7.4 μm | 9.1% | 58% | ca. 50 | 15 | 32 | 7000 | 2% |

TABLE 3-continued

| | Toners | | | | | | | | | | | |
|---|---|---|---|---|---|---|---|---|---|---|---|---|
| | Sulfur-containg polymer | tan δ at 100 kHg | | Contact | D4 | V % | N % | S-content | Acid value | THF ins | Molecular weight | content |
| Example | (wt. parts) | Max | Temp | angle | (μm) | (≧10.1 μm) | (Ci ≧ 0.950) | (ppm) | (mgKOH/g) | (wt %) | Mp | ≧$10^5$ (%) |
| 13 | S-6 (2) | $3.9 \times 10^{-2}$ | 104° C. | 122° | 7.6 μm | 8.7% | 58% | ca. 110 | 15 | 30 | 7000 | 1% |
| 14 | S-6 (0.1) | $2.6 \times 10^{-2}$ | 103° C. | 113° | 7.4 μm | 10% | 57% | <10 | 14 | 34 | 6800 | 1% |
| 15 | S-6 (7) | $4.1 \times 10^{-2}$ | 104° C. | 112° | 7.4 μm | 5.7% | 69% | ca. 720 | 14 | 26 | 7200 | 3% |
| 16 | S-7 (2) | $4.5 \times 10^{-2}$ | 104° C. | 127° | 7.6 μm | 5.6% | 73% | ca. 100 | 14 | 23 | 7400 | 5% |
| 17 | S-1 (2) | $5.3 \times 10^{-2}$ | 103° C. | 115° | 7.6 μm | 4.4% | 75% | ca. 100 | 15 | 10 | 7700 | 13% |
| 18 | S-1 (2) | $5.6 \times 10^{-2}$ | 103° C. | 118° | 7.9 μm | 6.1% | 66% | ca. 100 | 8 | 6 | 12700 | 14% |
| 19 | S-1 (2) | $2.8 \times 10^{-2}$ | 105° C. | 115° | 7.5 μm | 8.7% | 56% | ca. 100 | 23 | 37 | 4300 | 1% |
| Comp. 1 | S-8 (2) | $6.8 \times 10^{-2}$ | 97° C. | 98° | 7.6 μm | 14.1% | 50% | <10 | 9 | 61 | 16300 | 17% |
| Comp. 2 | S-9 (2) | $6.2 \times 10^{-2}$ | 95° C. | 98° | 7.6 μm | 12.7% | 53% | <10 | 9 | 52 | 15300 | 0.3% |
| Comp. 3 | S-10 (2) | $4.2 \times 10^{-2}$ | 95° C. | 98° | 7.6 μm | 13.5% | 52% | ca. 100 | 7 | 53 | 16100 | 3% |
| Comp. 4 | not added | $6.8 \times 10^{-2}$ | 103° C. | 101° | 7.6 μm | 13.7% | 52% | <10 | 6 | 56 | 16500 | 2% |

TABLE 3A

| | Toners | | | | | | | | | | | |
|---|---|---|---|---|---|---|---|---|---|---|---|---|
| | Sulfur-containg polymer | tan δ at 100 kHg | | Contact | D4 | V % | N % | S-content | Acid value | THF ins | Molecular weight (×$10^4$) | |
| Example | (wt. parts) | Max | Temp | angle | (μm) | (≧10.1 μm) | (Ci ≧ 0.950) | (ppm) | (mgKOH/g) | (wt %) | Mp | Msp |
| 20 | S-1 (2) | $4.8 \times 10^{-2}$ | 124° C. | 126° | 6.4 μm | 2.1% | 73% | ca. 100 | 5 | 9 | 1.1 | 53.7 |
| 21 | S-1 (2) | $5.3 \times 10^{-2}$ | 126° C. | 123° | 6.6 μm | 1.6% | 76% | ca. 100 | 9 | 17 | 0.7 | 37.3 |
| 22 | S-1 (2) | $2.8 \times 10^{-2}$ | 111° C. | 118° | 6.3 μm | 5.2% | 66% | ca. 100 | 3 | 2 | 2.1 | 25.9 |
| 23 | S-1 (2) | $4.2 \times 10^{-2}$ | 118° C. | 122° | 6.4 μm | 1.1% | 78% | ca. 100 | 5 | 7 | 1.1 | 53.8 |
| 24 | S-1 (2) | $4.7 \times 10^{-2}$ | 120° C. | 120° | 6.4 μm | 1.3% | 77% | ca. 100 | 5 | 11 | 1.1 | 53.5 |
| 25 | S-2 (2) | $3.5 \times 10^{-2}$ | 126° C. | 121° | 6.2 μm | 2.4% | 69% | ca. 70 | 5 | 10 | 1.0 | 51.4 |
| 26 | S-3 (2) | $3.1 \times 10^{-2}$ | 125° C. | 121° | 6.6 μm | 3.7% | 70% | ca. 90 | 5 | 8 | 1.3 | 54.1 |
| 27 | S-4 (2) | $3.6 \times 10^{-2}$ | 123° C. | 119° | 6.4 μm | 2.3% | 72% | ca. 30 | 5 | 8 | 1.3 | 54.6 |
| 28 | S-5 (2) | $3.2 \times 10^{-2}$ | 122° C. | 116° | 6.2 μm | 3.6% | 66% | ca. 80 | 5 | 12 | 1.05 | 51.2 |
| 29 | S-6 (2) | $2.9 \times 10^{-2}$ | 120° C. | 118° | 6.2 μm | 2.5% | 68% | ca. 80 | 5 | 11 | 1.0 | 53.2 |
| 30 | S-7 (2) | $5.1 \times 10^{-2}$ | 122° C. | 123° | 6.5 μm | 2.1% | 74% | ca. 100 | 5 | 6 | 1.2 | 54.5 |
| Comp. 5 | S-8 (2) | $2.2 \times 10^{-2}$ | 97° C. | 102° | 6.4 μm | 11.1% | 52% | <10 | 1 | 1 | 3.3 | 18.2 |
| Comp. 6 | S-9 (2) | $2.1 \times 10^{-2}$ | 132° C. | 96° | 6.6 μm | 11.3% | 53% | <10 | 2 | 1 | 3.7 | 17.6 |
| Comp. 7 | S-10 (2) | $2.3 \times 10^{-2}$ | 97° C. | 98° | 6.3 μm | 10.6% | 53% | ca. 100 | 2 | 1 | 4.1 | 15.9 |
| Comp. 8 | not added | $1.9 \times 10^{-2}$ | 98° C. | 103° | 6.4 μm | 10.1% | 54% | <10 | 2 | 1 | 3.2 | 18.9 |

TABLE 4

| | Toner performances | | | | | | | | | | | | | |
|---|---|---|---|---|---|---|---|---|---|---|---|---|---|---|
| | | | | | | | | | | | I.D. (Developing performance) in HT/HH | | | |
| | Developing and fixing performances | | | | | | | | | | GP-215 | | NP-6650 | |
| | GP-215 | | | | | NP-6650 | | | | | | After | | After |
| | I.D. | | Attachment | Fixing performances | | I.D. | | Attachment | Fixing performances | | | standing | | standing |
| Example | Initial | Final | on fixer | Fixability | Offset | Initial | Final | on fixer | Fixability | Offset | Initial | 24 hrs. | Initial | 24 hrs. |
| 1 | 1.41 | 1.42 | A | A | A | 1.40 | 1.42 | A | A | A | 1.40 | 1.36 | 1.40 | 1.35 |
| 2 | 1.42 | 1.46 | A | A | A | 1.42 | 1.44 | A | A | A | 1.41 | 1.36 | 1.40 | 1.36 |
| 3 | 1.39 | 1.42 | A | B | A | 1.38 | 1.41 | A | A | A | 1.37 | 1.32 | 1.36 | 1.30 |
| 4 | 1.37 | 1.38 | B | A | A | 1.37 | 1.40 | B | B | A | 1.35 | 1.31 | 1.34 | 1.30 |
| 5 | 1.36 | 1.36 | A | B | A | 1.36 | 1.37 | A | B | A | 1.35 | 1.31 | 1.35 | 1.30 |
| 6 | 1.43 | 1.38 | B | A | B | 1.44 | 1.38 | B | A | B | 1.39 | 1.36 | 1.38 | 1.34 |
| 7 | 1.42 | 1.40 | A | B | A | 1.41 | 1.40 | A | B | A | 1.38 | 1.33 | 1.39 | 1.31 |
| 8 | 1.42 | 1.40 | B | B | A | 1.41 | 1.41 | C | B | B | 1.40 | 1.32 | 1.40 | 1.33 |
| 9 | 1.41 | 1.40 | B | B | A | 1.42 | 1.41 | C | B | B | 1.40 | 1.26 | 1.37 | 1.25 |
| 10 | 1.41 | 1.40 | B | B | A | 1.41 | 1.38 | B | B | A | 1.39 | 1.28 | 1.38 | 1.23 |
| 11 | 1.39 | 1.39 | C | B | B | 1.40 | 1.41 | A | A | B | 1.36 | 1.28 | 1.38 | 1.29 |
| 12 | 1.40 | 1.42 | A | B | A | 1.41 | 1.44 | A | B | A | 1.40 | 1.32 | 1.39 | 1.30 |

TABLE 4-continued

| | Toner performances | | | | | | | | | | | | | |
|---|---|---|---|---|---|---|---|---|---|---|---|---|---|---|
| | | | | | | | | | | | I.D. (Developing performance) in HT/HH | | | |
| | Developing and fixing performances | | | | | | | | | | GP-215 | | NP-6650 | |
| | GP-215 | | | | | NP-6650 | | | | | | After | | After |
| | I.D. | | Attachment | Fixing performances | | I.D. | | Attachment | Fixing performances | | | standing | | standing |
| Example | Initial | Final | on fixer | Fixability | Offset | Initial | Final | on fixer | Fixability | Offset | Initial | 24 hrs. | Initial | 24 hrs. |
| 13 | 1.42 | 1.42 | A | B | B | 1.41 | 1.41 | A | B | B | 1.36 | 1.28 | 1.38 | 1.26 |
| 14 | 1.41 | 1.43 | A | B | A | 1.42 | 1.43 | A | B | B | 1.38 | 1.22 | 1.39 | 1.23 |
| 15 | 1.41 | 1.42 | B | B | A | 1.42 | 1.42 | A | A | A | 1.39 | 1.33 | 1.38 | 1.30 |
| 16 | 1.39 | 1.40 | C | A | B | 1.40 | 1.42 | C | A | B | 1.37 | 1.35 | 1.39 | 1.37 |
| 17 | 1.36 | 1.37 | B | A | B | 1.36 | 1.37 | A | B | A | 1.35 | 1.33 | 1.37 | 1.34 |
| 18 | 1.41 | 1.43 | C | A | C | 1.42 | 1.42 | C | B | A | 1.38 | 1.37 | 1.38 | 1.36 |
| 19 | 1.38 | 1.38 | A | B | A | 1.37 | 1.38 | A | B | A | 1.36 | 1.20 | 1.37 | 1.24 |
| Comp. 1 | 1.40 | 1.37 | D | C | B | 1.41 | 1.34 | D | C | B | 1.34 | 1.18 | 1.36 | 1.15 |
| Comp. 2 | 1.40 | 1.38 | D | C | B | 1.41 | 1.35 | D | C | B | 1.37 | 1.21 | 1.38 | 1.20 |
| Comp. 3 | 1.40 | 1.32 | D | C | C | 1.41 | 1.30 | D | C | C | 1.37 | 1.16 | 1.36 | 1.11 |
| Comp. 4 | 1.39 | 1.32 | C | B | C | 1.38 | 1.33 | C | C | B | 1.35 | 1.09 | 1.35 | 1.03 |

TABLE 4A

| | Toner performances | | | | | | | | | | | | | |
|---|---|---|---|---|---|---|---|---|---|---|---|---|---|---|
| | | | | | | | | | | | I.D. (Developing performance) in HT/HH | | | |
| | Developing and fixing performances | | | | | | | | | | GP-215 | | NP-6650 | |
| | GP-215 | | | | | NP-6650 | | | | | | After | | After |
| | I.D. | | Attachment | Fixing performances | | I.D. | | Attachment | Fixing performances | | | standing | | standing |
| Example | Initial | Final | on fixer | Fixability | Offset | Initial | Final | on fixer | Fixability | Offset | Initial | 24 hrs. | Initial | 24 hrs. |
| 20 | 1.43 | 1.45 | A | B | A | 1.45 | 1.46 | A | B | B | 1.43 | 1.34 | 1.42 | 1.34 |
| 21 | 1.40 | 1.41 | A | B | A | 1.42 | 1.41 | A | B | A | 1.41 | 1.31 | 1.39 | 1.32 |
| 22 | 1.38 | 1.38 | C | B | C | 1.37 | 1.38 | B | B | B | 1.37 | 1.33 | 1.36 | 1.32 |
| 23 | 1.40 | 1.41 | B | B | B | 1.41 | 1.42 | B | B | B | 1.35 | 1.31 | 1.35 | 1.36 |
| 24 | 1.39 | 1.38 | B | B | A | 1.39 | 1.40 | B | B | B | 1.36 | 1.32 | 1.36 | 1.31 |
| 25 | 1.42 | 1.43 | A | B | B | 1.41 | 1.41 | A | B | B | 1.38 | 1.40 | 1.37 | 1.39 |
| 26 | 1.40 | 1.42 | A | B | B | 1.41 | 1.41 | A | B | B | 1.37 | 1.39 | 1.37 | 1.38 |
| 27 | 1.41 | 1.42 | A | B | B | 1.43 | 1.41 | A | B | B | 1.38 | 1.39 | 1.37 | 1.38 |
| 28 | 1.41 | 1.43 | B | B | B | 1.41 | 1.40 | A | B | B | 1.39 | 1.39 | 1.36 | 1.38 |
| 29 | 1.39 | 1.39 | B | B | B | 1.40 | 1.40 | A | B | B | 1.38 | 1.30 | 1.37 | 1.26 |
| 30 | 1.40 | 1.42 | A | B | A | 1.41 | 1.40 | A | B | A | 1.37 | 1.33 | 1.38 | 1.33 |
| Comp. 5 | 1.33 | 1.32 | A | B | D | 1.32 | 1.30 | A | B | D | 1.30 | 1.19 | 1.31 | 1.21 |
| Comp. 6 | 1.30 | 1.32 | D | B | D | 1.31 | 1.30 | D | B | D | 1.27 | 1.23 | 1.28 | 1.13 |
| Comp. 7 | 1.34 | 1.30 | D | B | D | 1.31 | 1.30 | D | B | D | 1.27 | 1.23 | 1.28 | 1.23 |
| Comp. 8 | 1.29 | 1.12 | C | B | D | 1.21 | 1.20 | C | B | D | 1.23 | 1.08 | 1.24 | 1.07 |

Evaluation of the toner performances shown in Tables 4 and 4A was performed in the following manner for the respective items.

(1) Image Density (I.D.)

A reflection density of a 5 mm-dia. solid circular image was measured by using a Macbeth densitometer (made by Macbeth Co.) together with an SPI filter.

(2) Low-temperature Fixability (Fixability) According to "GP-215"

A solid black toner image having an image density of 1.3–1.4 wax fixed through a fixing device at a fixing temperature of 150° C., and the fixed toner image was rubbed with a lens-cleaning paper ("DUSPER", made by Ozu Sangyo K.K.) under a load of 4.9 kPa (50 g/cm$^2$). The fixability was evaluated according to the following standard depending on the percentage of image density lowering by the rubbing.

| |
|---|
| A: below 5% |
| B: 10% to below 15% |
| C: 10% to below 15% |
| D: 15% to below 20% |
| E: 20% or above |

(2A) Low-temperature Fixability (Fixability) According to "NP-6550"

An identical test as according to "GP-215" described above was performed except for using the fixing device at a fixing temperature of 180° C. and the same evaluation standard based on the image density lowering by the rubbing was adopted.

(3) Anti-hot-offset Characteristic (Offset)

Evaluated according to the following standard.

A: No offset at all.

B: Slight offset occurred but at a practically acceptable level.

C: Offset occurred at a level easily recognizable with eyes.

D: Conspicuous offset occurred.

E: Paper winding about the roller occurred.

(4) Soiling with Toner Attached onto the Fixing Members of the Fixing Device

Evaluated according to the following standard.

A: No toner soiling at all.

B: Slight soiling occurred but at a practically acceptable level.

C: Soiling occurred at a level easily recognizable with eyes.

D: Conspicuous soiling observed.

E: Soiling toner attached onto paper surface or back surface.

What is claimed is:

1. A toner, comprising toner particles each comprising at least a binder resin, a colorant and a wax, and inorganic fine powder, wherein (a) the toner contains a sulfur-containing polymer, and (b) the toner shows dielectric loss tangent (tanδ) values at 100 kHz assuming a maximum of $2.5\times10^{-2}$ to $8\times10^{-2}$ in a temperature range of 100 to 130° C.

2. The toner according to claim 1, wherein the sulfur-containing polymer is a polymer having a sulfonic acid group.

3. The toner according to claim 1, wherein the sulfur-containing polymer is a polymer having polymerized units of an acrylamido-sulfonic acid derivative monomer.

4. The toner according to claim 1, wherein the sulfur-containing polymer is a polymer having polymerized units of 2-acrylamido-2-methylpropane sulfonic acid monomer.

5. The toner according to claim 1, wherein the sulfur-containing polymer functions as a charge control agent.

6. The toner according to claim 1, wherein the sulfur-containing polymer is contained in an amount of 0.01 to 20 wt. parts per 100 wt. parts of the binder resin.

7. The toner according to claim 1, wherein the sulfur-containing polymer is contained in an amount of 0.5 to 5 wt. parts per 100 wt. parts of the binder resin.

8. The toner according to claim 1, wherein the sulfur-containing polymer has a weight-average molecular weight (Mw) of $2\times10^3$–$2\times10^5$.

9. The toner according to claim 1, wherein the sulfur-containing polymer has a weight-average molecular weight (Mw) of $1\times10^4$–$2\times10^5$.

10. The toner according to claim 1, wherein the sulfur-containing polymer has a glass-transition temperature (Tg) of 30 to 120° C.

11. The toner according to claim 1, wherein the sulfur-containing polymer has a glass-transition temperature (Tg) of 50 to 100° C.

12. The toner according to claim 1, wherein the toner shows dielectric loss tangent (tanδ) values measured at 100 kHz assuming a maximum of $3\times10^{-2}$ to $7\times10^{-2}$ in a temperature range of 100 to 130° C.

13. The toner according to claim 1, wherein the toner has an acid value of 1 to 40 mgKOH/g.

14. The toner according to claim 1, wherein the toner has an acid value of 10 to 20 mgKOH/g.

15. The toner according to claim 1, wherein the binder resin contains 1 to 50 wt. % of tetrahydrofuran (THF)-insoluble matter.

16. The toner according to claim 1, wherein the binder resin contains 10 to 30 wt. % of tetrahydrofuran (THF)-insoluble matter.

17. The toner according to claim 1, wherein the binder resin has an acid value of 1 to 40 mgKOH/g.

18. The toner according to claim 1, wherein the binder resin contains at least 50 wt. % of polyester.

19. The toner according to claim 1, wherein the binder resin contains at least 70 wt. % of polyester.

20. The toner according to claim 1, wherein the binder resin comprises polyester and contains a THF-soluble matter giving a GPC chromatogram showing a peak in a molecular weight region of $2\times10^3$ to $1.5\times10^5$ and contain 0.5 to 15% of components in a molecular weight region of $10^5$ to below $10^7$.

21. The toner according to claim 1, wherein the binder resin comprises polyester and contains a THF-soluble matter giving a GPC chromatogram showing a peak in a molecular weight region of $6\times10^3$ to $10^4$ and contain 2 to 10% of components in a molecular weight region of $10^5$ to below $10^7$.

22. The toner according to claim 1, wherein the binder resin comprises a vinyl polymer and contains a THF-soluble matter giving a GPC chromatogram showing a peak in a molecular weight region of $3\times10^3$ to $3\times10^4$ and a sub-peak and/or a shoulder in a molecular weight region of $2\times10^5$ to $1.5\times10^6$.

23. The toner according to claim 1, wherein the binder resin comprises a vinyl polymer and contains a THF-soluble matter giving a GPC chromatogram showing a peak in a molecular weight region of $7\times10^3$ to $2.5\times10^4$ and a sub-peak and/or a shoulder in a molecular weight region of $3\times10^5$ to $1.2\times10^6$.

24. The toner according to claim 1, wherein the binder resin comprises a vinyl polymer and contains a THF-soluble matter giving a GPC chromatogram showing a peak in a molecular weight region of $9\times10^3$ to $2\times10^4$ and a sub-peak and/or a shoulder in a molecular weight region of $2\times10^5$ to $1.0\times10^6$.

25. The toner according to claim 1, wherein the toner contains a charge control agent selected from the group consisting of organo-aluminum compounds and organo-iron compounds.

26. The toner according to claim 1, wherein the wax has a molecular weight distribution giving a main peak in a molecular weight region of 300 to 20000 and a ratio (Mw/Mn) of 1.0 to 20.

27. The toner according to claim 1, wherein the wax has a molecular weight distribution giving a main peak in a molecular weight region of 700 to 5000 and a ratio (Mw/Mn) of 1.2 to 15.

28. The toner according to claim 1, wherein the wax is a member selected from the group consisting of hydrocarbon waxes, polyethylene wax and polypropylene wax.

29. The toner according to claim 1, wherein the wax comprises a component having a structure represented by formula (1) below:

$$CH_3—(CH_2—CH_2)_x—CH_2—CH_2—A \quad (1),$$

wherein A denotes a hydroxyl group or a carboxyl group, and x is an integer of 20 to 60.

30. The toner according to claim 1, wherein the wax is a member selected from the group consisting of acid-modified polyethylene wax and acid-modified polypropylene wax, and has an acid value of 1 to 20 mgKOH/g.

31. The toner according to claim 1, wherein the wax has a thermal property giving a DSC curve showing at least one peak in a temperature region of 70 to 150° C.

32. The toner according to claim 1, wherein the wax has a thermal property giving a DSC curve showing at least one peak in a temperature region of 80 to 110° C.

33. The toner according to claim 1, wherein the wax comprises at least two wax species, and has a molecular weight distribution giving a main peak in a molecular weight region of 300 to 20000 and a ratio (Mw/Mn) of 1.2 to 25.

34. The toner according to claim 1, wherein the wax comprises at least two wax species, and has a molecular weight distribution giving a main peak in a molecular weight region of 400 to 5000 and a ratio (Mw/Mn) of 2 to 10.

35. The toner according to claim 1, wherein the toner contains 55 to 90% by number of particles having a circularity Ci represented by formula (2) below of at least 0.950:

$$Ci=L_0/L \quad (2);$$

wherein L represents a peripheral length of a projection image (two dimensional image) of an individual toner particle, and $L_0$ represents a peripheral length of a circle giving an identical area as the projection image.

36. The toner according to claim 35, wherein the toner contains 60 to 80% by number of particles having a circularity Ci of at least 0.950.

37. The toner according to claim 1, wherein the toner has a weight-average particle size of 4 to 12 $\mu$m and contains at most 70% by volume of particles of 10.1 $\mu$m or larger.

38. The toner according to claim 1, wherein the toner has a weight-average particle size of 5.5 to 8 $\mu$m and contains at most 20% by volume of particles of 10.1 $\mu$m or larger.

39. The toner according to claim 1, wherein the toner contains an external additive comprising an inorganic fine powder having a BET specific surface area of at least 30 $m^2/g$.

40. The toner according to claim 1, wherein the toner contains an external additive comprising a surface-treated inorganic fine powder having a BET specific surface area of at least 20 $m^2/g$.

41. The toner according to claim 1, wherein the toner contains an external additive comprising an inorganic fine powder having a methanol wettability of at least 30%.

42. The toner according to claim 1, wherein the toner contains an external additive comprising an inorganic fine powder having a methanol wettability of at least 50%.

43. An image forming method, comprising:

(i) a developing step of developing an electrostatic image held on an image-bearing member with a negatively chargeable toner to form a toner image thereon, (ii) a transfer step of transferring the toner image formed on the image-bearing member onto a recording material via or without via an intermediate transfer member, and (iii) a fixing step of heat-fixing the transferred toner image onto the recording material wherein the negatively chargeable toner comprises toner particles each comprising at least a binder resin, a colorant and a wax, and inorganic fine powder, wherein (a) the toner contains a sulfur-containing polymer, and (b) the toner shows dielectric loss tangent (tanδ) values at 100 kHz assuming a maximum of $2.5\times10^{-2}$ to $8\times10^{-2}$ in a temperature range of 100 to 130° C.

44. A process cartridge for use in an image forming apparatus of the type wherein an electrostatic image formed on an image-bearing member is developed with a toner transferred thereto to form a toner image and the toner image is transferred onto a recording material to form an image product, wherein the process cartridge comprises at least one member selected from the group consisting of the image-bearing member, a charging means for charging the image-bearing member, a latent image forming means for forming the electrostatic image on the image-bearing member, a transfer means for transferring the toner image on the image-bearing member onto a recording material and a cleaning means for removing transfer residual toner remaining on the image-bearing member remaining after the transfer of the toner image, and a developing means for developing the electrostatic image on the image-bearing member with a toner to form the toner image on the image-bearing member supported integrally with said at least one member to form a unit which is detachably mountable to the image forming apparatus, and the toner comprises toner particles each comprising at least a binder resin, a colorant and a wax, and inorganic fine powder, wherein (a) the toner contains a sulfur-containing polymer, and (b) the toner shows dielectric loss tangent (tanδ) values at 100 kHz assuming a maximum of $2.5\times10^{-2}$ to $8\times10^{-2}$ in a temperature range of 100 to 130° C.

* * * * *

UNITED STATES PATENT AND TRADEMARK OFFICE

CERTIFICATE OF CORRECTION

PATENT NO. : 6,653,038 B2
DATED : November 25, 2003
INVENTOR(S) : Satoshi Matsunaga et al.

It is certified that error appears in the above-identified patent and that said Letters Patent is hereby corrected as shown below:

Column 25,
Line 20, "($W_{MeO11}$)" should read -- ($W_{MeOH}$) --.

Column 39,
Line 55, "$1x10^4$-$2x10^5$." should read -- $1x10^4$-$1x10^5$. --.

Signed and Sealed this

Sixth Day of July, 2004

JON W. DUDAS
*Acting Director of the United States Patent and Trademark Office*